United States Patent [19]

Fujimori et al.

[11] Patent Number: 4,633,749

[45] Date of Patent: Jan. 6, 1987

[54] TONE SIGNAL GENERATION DEVICE FOR AN ELECTRONIC MUSICAL INSTRUMENT

[75] Inventors: Junichi Fujimori; Jun Sugiyama, both of Hamamatsu, Japan

[73] Assignee: Nippon Gakki Seizo Kabushiki Kaisha, Hamamatsu, Japan

[21] Appl. No.: 690,771

[22] Filed: Jan. 9, 1985

[30] Foreign Application Priority Data

Jan. 12, 1984 [JP] Japan ..... 59-2667
Jan. 19, 1984 [JP] Japan ..... 59-6249
Apr. 10, 1984 [JP] Japan ..... 59-71658

[51] Int. Cl.[4] ..... G10H 1/00
[52] U.S. Cl. ..... 84/1.01; 84/1.28
[58] Field of Search ..... 84/1.01, 1.28

[56] References Cited

U.S. PATENT DOCUMENTS 3,809,786 5/1974 Deutsch ..... 84/1.01
3,821,714 6/1974 Tomisawa ..... 340/172.5
3,888,153 6/1975 Deutsch ..... 84/1.01
4,133,241 1/1979 Niimi et al. ..... 84/1.01
4,215,619 8/1980 Budelman et al. ..... 84/1.28
4,231,277 11/1980 Wachi ..... 84/1.01
4,246,823 1/1981 Wachi et al. ..... 84/1.01
4,348,929 9/1982 Gallitzendörfer ..... 84/1.28
4,520,708 6/1985 Wachi ..... 84/1.01

*Primary Examiner*—Russell E. Adams
*Attorney, Agent, or Firm*—Spensley Horn Jubas & Lubitz

[57] ABSTRACT

A musical tone signal generator for an electronic musical instrument is constructed by a waveshape generator, a function generator and an interpolator. The waveshape generator successively generates adjacent two waveshapes of a plurality of different waveshapes which have been intermittently sampled in an actual produced tone. The function generator generates an interpolation function which is a function of time. The interpolator weights the adjacent two waveshapes in accordance with the interpolation function, combines the weighted two waveshapes and outputs the combined waveshape as a musical tone waveshape to be produced at a rate corresponding to a frequency of the musical tone waveshape. In the waveshape generator, the generation of next two adjacent waveshapes are performed when a value of the interpolation function has become equal to a predetermined value. As a result, it is made possible to obtain a good quality timewise spectrum change of the musical tone waveshape.

48 Claims, 37 Drawing Figures

TONE SIGNAL GENERATION DEVICE FOR AN ELECTRONIC MUSICAL INSTRUMENT

BACKGROUND OF THE INVENTION

This invention relates to a tone signal generation device adapted for use in an electronic musical instrument and other apparatus having a tone generation function and, more particularly, to a tone signal generation device capable of generating a tone signal whose spectrum components change with the lapse of time by successively generating different tone waveshapes as well as capable of generating a tone signal containing a non-harmonic component.

Japanese Preliminary Patent Publication No. 95790/1983 discloses a tone signal generation device capable of generating a tone signal whose spectrum components change with the lapse of time by successively reading out different tone waveshapes stored in a waveshape memory. In this device, switching of tone waveshapes to be read out from the memory is effected each time the same tone waveshape has been repeatedly read out for a given number of periods. Besides, for smooth transition from a preceding tone waveshape to a next tone waveshape at the time of switching, an interpolation between corresponding sample points of the two waveshapes is performed and this interpolation is carried out for the given number of periods during which the same tone waveshape is repeatedly read out.

In the above described prior art device, the interval between switchings of tone waveshapes is fixed to a predetermined number of periods and, accordingly, the interval of switching varies depending upon the frequency of a tone to be generated and therefore time required for the interpolation varies. This gives rise to the problem that the higher the frequency of a tone, the faster the tone waveshape switches with a result that the timewise change effect of the spectrum components become unequal depending upon the tone pitch. Further, the higher the frequency of a tone, the faster is performed the interpolation at the switching between the waveshapes so that the effect of the smooth transition between the different waveshapes is reduced.

It is, therefore, an object of the invention to provide a tone signal generation device which has eliminated the above described disadvantages of the prior art device by controlling the switching between the tone waveshapes without being affected by the frequency of a tone to be generated.

The above described prior art device discloses also an art of interpolation according to which weighting is carried out with respect to both a preceding waveshape and a following waveshape at the time of switching between the waveshapes so as to realize smooth transition from the former to the latter. Since in the disclosed method of interpolation, difference between the preceding tone waveshape and the following tone waveshape is computed for each corresponding sample point and this difference is multiplied with a weighting coefficient and thereafter the product is added to sample point amplitude data of the preceding tone waveshape, gain of a tone waveshape signal finally obtained is always "1" no matter what value the weighting coefficient may be with resulting lack in variety in the interpolation characteristics. Assuming that the amplitude level of a preceding waveshape is represented by A, that of a following waveshape by B, a weighting coefficient by X, the level of a tone waveshape signal obtained is $A+X(B-A)=A(1-X)+BX$ and gain is always "1". Besides, in a case where a function of a weighting coefficient (interpolation function) is determined as desired, the above described method of interpolation produces deviation in the interpolation characteristics so that a smooth interpolation cannot be expected. For instance, in a case where the weighting coefficient changes exponentially with respect to time, the level of the preceding tone waveshape tends to remain in a high value and the level of the following waveshape increases abruptly immediately before the end of the interpolation with a result that a smooth interpolation cannot be expected. Accordingly, it is only in the interpolation in a linear section that an impartial and smooth interpolation can be realized.

It is therefore a second object of the invention to provide a tone signal generation device capable of setting desired interpolation characteristics by freely setting a function concerning weighting and moreover capable of eliminating the deviation in the interpolation characteristics and realizing smooth transition of a tone waveshape.

Tones produced by acoustic musical instruments, particularly string-striking musical instruments such as piano and harpsichord, contain components which are not in an exact harmonic relationship of the notes of these tones (i.e., nonharmonic components). Since in the known tone signal generation system in which tone waveshapes stored in a waveshape memory are simply read out repeatedly can produce only harmonics of integer multiples, such known system cannot produce a tone signal containing a nonharmonic component. On the other hand, an electronic musical instrument of a type in which individual harmonic components are separately calculated and synthesized together, synthesis of a tone signal containing nonharmonic components is possible as is disclosed in the specification of U.S. Pat. No. 3,888,153. More specifically, a partial tone signal of a nonharmonic component is generated by causing the frequency of each individually generated harmonic component to deviate slightly from an integer multiple of the fundamental frequency as required and then partial tone signals are synthesized with the nonharmonic partial tone signal to provide a tone signal containing a nonharmonic component.

This prior art device however has the disadvantage that it requires a large-scale hardware because it necessitates a construction in which partial tone signals corresponding to the fundamental wave and respective harmonics must be produced individually and separately and relative amplitudes of these partial tone signals must be individually controlled before synthesizing these signals.

It is therefore a third object of the invention to provide a tone signal generation device capable of readily producing a tone signal containing a nonharmonic component with a relatively simple construction.

SUMMARY OF THE INVENTION

For achieving the above described first object of the invention, the tone signal generation device according to the invention comprises waveshape memory means for storing waveshape data corresponding to respective sample points of a plurality of different tone waveshapes which are divided into a plurality of said sample points, waveshape designation means for designating a tone waveshape to be read out from said waveshape memory means and timewise switching the tone waveshape to be designated, readout means for repeatedly reading out waveshape data of a designated tone waveshape from said waveshape memory means in response to the frequency of a tone to be generated, and interpolation means for weighting both a preceding tone waveshape and a following tone waveshape according to a predetermined interpolation function at a time when the tone waveshape to be read out is switched so as to achieve smooth transition from the preceding tone waveshape to the following waveshape and characterized in that said device comprises counting means for generating a time function for establishing said interpolation function, and switching control means responsive to the output of said counting means for controlling switching between waveshapes in said waveshape designation means.

The counting means generates the time function regardless of the frequency of a tone to be generated. In the interpolation means, timewise change in weighting is set in accordance with this time function. In the switching control means, switching between waveshapes is controlled at a predetermined time point in response to the output of the counting means, i.e., the time function. In the waveshape designation means, designation of a tone waveshape is switched in accordance with the control of the switching control means. Thus, switching and interpolation of a tone waveshape are controlled in accordance with an independent time function which is irrelevant to the tone frequency whereby the timewise change effect of spectrum components unaffected by variation in the tone pitch is obtained and moreover an interpolation (transition between waveshapes) which is smooth over all tone ranges is ensured. This invention, however, does not necessarily exclude taking the tone pitch factor more or less into account.

For achieving the above described second object of the invention, the invention is characterized in that the interpolation means comprises interpolation function memory means storing an interpolation function for weighting which undergoes timewise change between start and end of switching of a tone waveshape, and interpolation control means for performing weighting of the preceding tone waveshape and the following tone waveshape separately by an output obtained by reading out this interpolation function memory means in a forward direction and by an output obtained by reading out this interpolation function memory means in a reverse direction. In the interpolation function memory means, and desired interpolation function can be stored so that weighting characteristics in the interpolation section can be freely set and desired interpolation characteristics thereby can be obtained. Further, since the weighting of the two tone waveshapes are separately made by the output obtained by reading out the interpolation memory means forwardly and the output obtained by reading it out reversely, the two tone waveshapes are weighted by interpolation characteristics which are opposite to each other so that interpolation of symmetrical characteristics which is not partial to either waveshape is ensured regardless of the type of interpolation function (weighting function) employed.

This will be explained more fully with reference to FIGS. 30*a* and 30*b*. FIG. 30*a* shows the prior art interpolation method in which X represents a weighting coefficient which is a desired function (an exponential function in the figure) of $X=f(t)$. $A(1-X)$ represents the level of a preceding tone waveshape after the interpolation which is indicated by oblique lines rising from left to right. BX represents the level of a following waveshape after the interpolation which is indicated by oblique lines rising from right to left. In this case, it will be understood that interpolation characteristics which is partial to the preceding tone waveshape is obtained. FIG. 30*b* shows the interpolation method according to the invention in which $Y=g(t)$ represents a function obtained by reading out the function $X=f(t)$ reversely. The preceding tone waveshape is weighted by this function and the level AY after weighting is indicated by oblique lines rising from left to right. The following tone waveshape is weighted by the function $X=f(t)$ and the level BX after weighting is indicated by oblique lines rising from right to left. As will be apparent from FIG. 30*b*, the two tone waveshapes are symmetrically interpolated without being partial to either one. That is, the level AY first is large and the level BX is small. Then the two levels become equal in the middle and in the latter half section, the level BX is large and the level AY is small in symmetry to the change in the former half section. Accordingly, waveshape switches from one to another smoothly and impartially regardless of the type of the interpolation function. In contrast, in FIG. 30*a*, the level $A(1-X)$ is partially large as a whole and the level BX increases immediately before the end of the interpolation so that it is not a very smooth transition.

For achieving the third object, the invention is characterized in that each tone waveshape stored in the waveshape memory means contains a fundamental component harmonics components and that, with respect to all or predetermined ones of the respective tone waveshapes, at least one of these components is provided with a phase difference between tone waveshapes which are adjacent to each other in the order of switching, whereby nonharmony determined by this phase difference and time (interpolation time) required for transition of waveshapes by the interpolation means is realized.

The tone signal obtained by the interpolation performed by the interpolation means is not the tone waveshape itself which is read out from the waveshape memory means but tone waveshape which is shifted smoothly from a preceding waveshape to a following waveshape. The transition of the tone waveshapes can be analized component by component. That is, as to the n-th component, smooth transition from the n-th component of the preceding tone waveshape to the n-th component of the following waveshape is realized. Observing initial phase of the tone waveshape, the initial phase of the tone waveshape obtained by the interpolation changes gradually from the initial phase of the n-th component of the preceding tone waveshape to the initial phase of the n-th component of the following tone waveshape. In this case, as to a component which is not provided with a phase difference between adjacent tone waveshapes, its initial phase does not change during the interpolation. Thus, as to the component which is not provided with a phase difference, a harmonic frequency of integer multiple as indicated by the order number of the harmonic is obtained. As to a component which are provided with a phase difference between adjacent tone waveshapes, its initial phase changes gradually from the initial phase of the preceding tone waveshape to that of the following tone waveshape during the interpolation. By transition of the initial phase of a specific component during the interpolation, the frequency of this component does not become the original frequency of integer multiple but become a frequency which is more or less deviated from it. Thus, this specific component becomes a nonharmonic frequency and a tone signal containing a nonharmonic component thereby is obtained.

The principle of generation of such nonharmonic frequency will be described in detail with reference to FIG. 31. In FIG. 31, a second harmonic component (represented by $SEG1_2$) contained in a preceding tone waveshape and a second harmonic component (represented by $SEG2_2$) contained in a next tone waveshape are taken out and shown. Explanation will be made on a case where a predetermined phase difference has been provided to the second harmonic components. FIG. 31 is drawn in three-dimensional co-ordinates in which the X axis represents phase, the Y axis amplitude and the Z axis time respectively. The start point of the interpolation is represented by $t_{ls}$ and the end point thereof by $t_{le}$ and it is assumed that a linear interpolation is carried out between $t_{ls}$ and $t_{le}$ from $SEG1_2$ to $SEG2_2$. In the figure, phase difference between the two second harmonics is assumed to be 22.5 degrees.

Assuming that the fundamental frequency is 440 Hz (corresponding to A4 tone), the frequency of the second harmonic is 880 Hz (1 period being 1.136 ms). Assuming also that the interpolation period from $t_{ls}$ to $t_{le}$ is set to be 18.182 ms which is equivalent to 16 periods of this second harmonic, if there was no phase difference between these two components $SEG1_2$ and $SEG2_2$, a second harmonic of 16 periods would be generated in this interpolation period so that the frequency of the synthesized second harmonic component would be just double that of the fundamental wave. Since, however, there is the phase difference of 22.5 degrees between the components $SEG1_2$ and $SEG2_2$, the initial phase of the second harmonic synthesized by the interpolation is gradually shifted so that it is shifted by 22.5 degrees at the interpolation end point $t_{le}$ as compared with the phase at the interpolation start point $t_{ls}$. The direction of this phase shift is determined by the direction of phase shift of $SEG2_2$ relative to $SEG1_2$ which is the direction in which the phase advances in the example illustrated. Since 22.5 degrees corresponds to $$\frac{22.5}{360} = 0.0625 \text{ period},$$

a second harmonic component having 16.0625 periods during the interpolation period $t_{ls}$–$t_{le}$ is produced. Frequency $f_2$ corresponding to this second harmonic is not exactly 880 Hz which is the frequency of a second harmonic but is $$f_2 = \frac{16.0625 \text{ (periods)}}{18.182 \text{ (ms)}} \times 1000 \text{ (ms)} = 883.44 \text{ (Hz)}.$$

In other words, the second harmonic component is synthesized as a nonharmonic component which is deviated by about 3.44 Hz from the integer multiple frequency.

Nonharmonic components may be synthesized for components of other harmonic orders on the basis of the same principle. If, for example, phase difference of a third harmonic component is 45 degrees in the same condition as the above described case, a frequency $f_3$ of a synthesized third harmonic component becomes $$f_3 = \frac{24.125 \text{ (period)}}{18.182 \text{ (ms)}} \times 1000 \text{ (ms)} = 1326.9 \text{ (Hz)}$$

while a normal integer multiple frequency is 1320 Hz. The period corresponding to the phase difference of 45 degrees is $$\frac{45}{360} = 0.125 \text{ (period)}.$$

If phase difference of a fourth harmonic component is 90 degrees in the same condition as the above cases, a frequency $f_4$ of a synthesized fourth harmonic component become $$f_4 = \frac{32.25 \text{ (period)}}{18.182 \text{ (ms)}} \times 1000 \text{ (ms)} = 1773.8 \text{ (Hz)}.$$

The period corresponding to the phase difference of 90 degrees is $$\frac{90}{360} = 0.25 \text{ (period)}.$$

Phase difference as described above may be provided not only for harmonic components but also for the fundamental component. In the latter case, a nonharmonic relationship can be produced between a fundamental component which is slightly deviated from a normal frequency and a harmonic component which is not deviated at all.

The present application is applicable not only to a type of device in which a tone waveshape which is an object of interpolation is formed by reading out tone waveshapes from waveshape memory means storing intermittently sampled different tone waveshapes but also advantageously to a type of device in which a tone waveshape is formed by employing parameters. As an example of such tone waveshape forming system employing parameters, the harmonic synthesizing system may be cited. In this harmonic synthesizing system, timewise change in the spectrum of a tone signal has been conventionally effected by preparing many sets of harmonic coefficients setting relative amplitudes of respective harmonics and timewise changing these sets of coefficients to utilize them in a tone waveshape forming operation. This necessitates a memory of a large capacity storing the harmonic coefficients and besides a smooth timewise change in the tone waveshape is not expected. If a parameter type tone forming means is employed in the present invention, timewise change in the tone waveshape by the interpolation according to the invention can be advantageously realized in the harmonic synthesis operation system or other parameter type systems. According to the invention, the above described waveshape memory means and readout means may be replaced by tone waveshape forming means for forming a tone waveshape of a shape determined by a parameter and forming the tone waveshape in accordance with phase designated by phase data, parameter memory means for storing the parameters determining the shape of respective tone waveshapes with respect to different tone waveshapes which have been intermittently sampled between the start to end of sounding of a tone and phase data generation means for generating the phase data which changes in response to the frequency of the tone to be generated and providing the phase data to the tone waveshape forming means. In this case, the previously described waveshape designation means designates a tone waveshape to be formed in the tone waveshape forming device, switching it timewise and reads out one of the parameters corresponding to the designated tone waveshape from the parameter memory means to supply it to the tone waveshape forming means.

Preferred embodiments of the invention will be described in detail below with reference to the accompanying drawings.

BRIEF DESCRIPTION OF THE DRAWINGS

In the accompanying drawings.

DESCRIPTION OF PREFERRED EMBODIMENTS

Figure 1A:
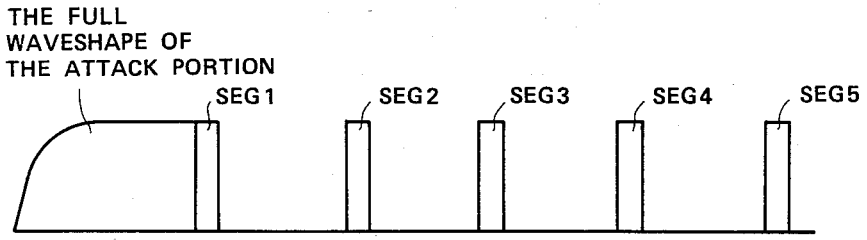
FIGS. 1*a* and 1*b* are schematic views for explaining the principle of the tone signal generation in an embodiment of the invention.
Figure 1B:
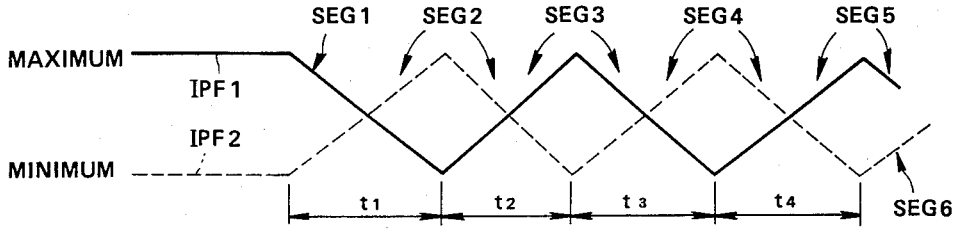
Figure 30A:
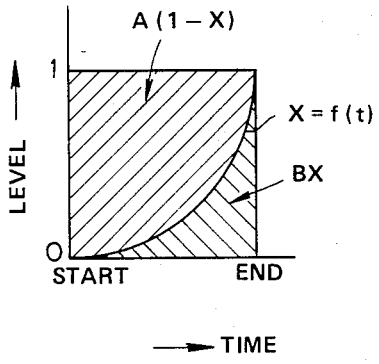
FIGS. 30*a* and 30*b* show an example of interpolation characteristics for explaining difference between the conventional interpolation and the interpolation according to the invention.
Figure 30B:
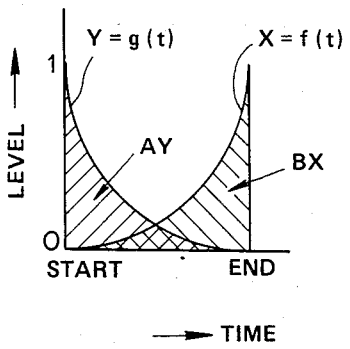

Referring first to FIGS. 1*a* and 1*b*, description will be made on the principle of the tone signal generation used in the embodiment to be described below. For the sake of convenience, FIG. 1*a* shows only the amplitude envelope to diagramatically describe the tone waveshape to be prepared in the waveshape memory. Because the tone waveshape changes in a complicated manner for a given period of time from the start of sounding, simulation of a good quality waveshape for the attack portion is difficult when depending on the repetitive reading of a single-period waveshape. Therefore, the attack portion is in intact manner stored in the waveshape memory according to this embodiment. In all the sounding period following the attack portion, one period of a plurality of different tone waveshapes is sampled intermittently and stored in the waveshape memory. Thus a plurality of tone waveshapes are prepared in correspondence to intermittent time periods and stored in the waveshape memory. These plural waveshapes are used in the interpolation operation according to the invention. FIG. 1*a* shows the intermittently sampled waveshapes of a single period SEG1 to SEG5. These will be called segment waveshapes below for the sake of convenience. The waveshapes stored in the waveshape memory are read out basically as follows: First, the full waveshape of the attack portion is read out continuously, the segment waveshape SEG1 to SEG5 are selected in order at a timing following the waveshape switching command to be described later and the one period of the selected segment waveshapes is read out repeatedly. For instance, when the reading of the attack portion waveshape is completed, the first segment waveshape SEG1 is read repeatedly for a certain period of time and then the second segment waveshape SEG2 is read repeatedly, thus switching one segment waveshape to another thereafter. The interpolation is used to obtain a smooth transition from one waveshape segment to the following at the switching of these waveshapes. In this case, one segment waveshape and the following segment waveshape are both read out at least in the interval where the interpolation is to be performed and both are weighted respectively according to appropriate interpolation functions. By way of example, the entire switching interval of the segment waveshapes is the interpolation interval, where the first segment waveshape SEG1 is read out together with the second segment waveshape SEG2, and at the next switching interval, the second and the third segment waveshape SEG2 and SEG3 are read out together, thus adjacent two segment waveshapes being read out together at each switching interval.

FIG. 1*b* shows an example of the interpolation functions. The solid line denotes a first-channel interpolation function IPE1 and the dot line denotes a second-channel interpolation function IPE2. The first channel corresponds to one of the two segment waveshapes read for the interpolation and the second channel corresponds to the other segment waveshape. These interpolation function IPF1 and IPF2 indicate the amounts of weighting applied to the waveshape amplitudes in the respective channels, the minimum being zero (meaning that the waveshape is not produced). In the attack portion where the interpolation is not effected, the first-channel interpolation function IPF1 is kept at its maximum while the second-channel interpolation function IPF2 at its minimum. Upon termination of the attack portion, in the intervals where the interpolation is effected on the segment waveshapes SEG1 to SEG5, the interpolation functions IPF1 and IPF2 change with the lapse of time according to respective given characteristics. The interpolation functions IPF1 and IPF2 change according to characteristics inverse to each other so that the weighting of one channel decreases while the weighting of the other channel increases, thus achieving a smooth transition of one waveshape to another. While the interpolation functions IPF1 and IPF2 show linear characteristics in FIG. 1*b*, these functions may be course possess characteristics of different types.

The slopes of the interpolation functions IPF1 and IPF2 of the respective channels are switched alternately as the separate interpolation sections $t_1$, $t_2$, $t_3$, $t_4$ are switched from one to another. In the interpolation section $t_1$, the interpolation is effected so as to enable a smooth transition from the segment waveshape SEG1 to SEG2. In this case, the segment waveshape SEG1 is read repeatedly in the first channel while the segment waveshape SEG2 is read repeatedly in the second channel. While the first-channel interpolation function IPF1 decreases gradually from its maximum, the second-channel interpolation function IPF2 increases from its minimum gradually. The plural-period waveshape signal of the segment waveshape SEG1 repeatedly read in the first channel is weighted (amplitude controlled) according to the interpolation function IPF1 while the plural-period waveshape signal of the segment waveshape SEG2 repeatedly read in the second channel is weighted according to the interpolation function IPF2. Mixing of the waveshape signals of both channels thus weighted according to the opposite characteristics makes it possible to obtain a tone signal in which the segment waveshape SEG1 smoothly changes with the lapse of time into the segment waveshape SEG2.

In the following interpolation section $t_2$, the interpolation is effected whereby the segment waveshape SEG2 smoothly changes into SEG3. In this case, the segment waveshape SEG2 is read repeatedly in the second channel, as in the preceding section, while in the first channel, the segment waveshapes are switched from SEG1 to SEG3, which is read repeatedly. Meantime, the slopes of the interpolation functions IPF1 and IPF2 change to assume the opposite directions to those in the preceding section.

Similarly in the other interpolation sections $t_3$ and $t_4$, the segment waveshapes are switched from one to another in one of the two channels while the slopes of the interpolation functions IPF1 and IPF2 are switched to assume the opposite directions to those in the preceding section. In Fig. 1*b* characters SEG1 to SEG5 are added to the segment waveshapes used in the first and second channels in the interpolation sections $t_1$ to $t_4$.

Figure 2:
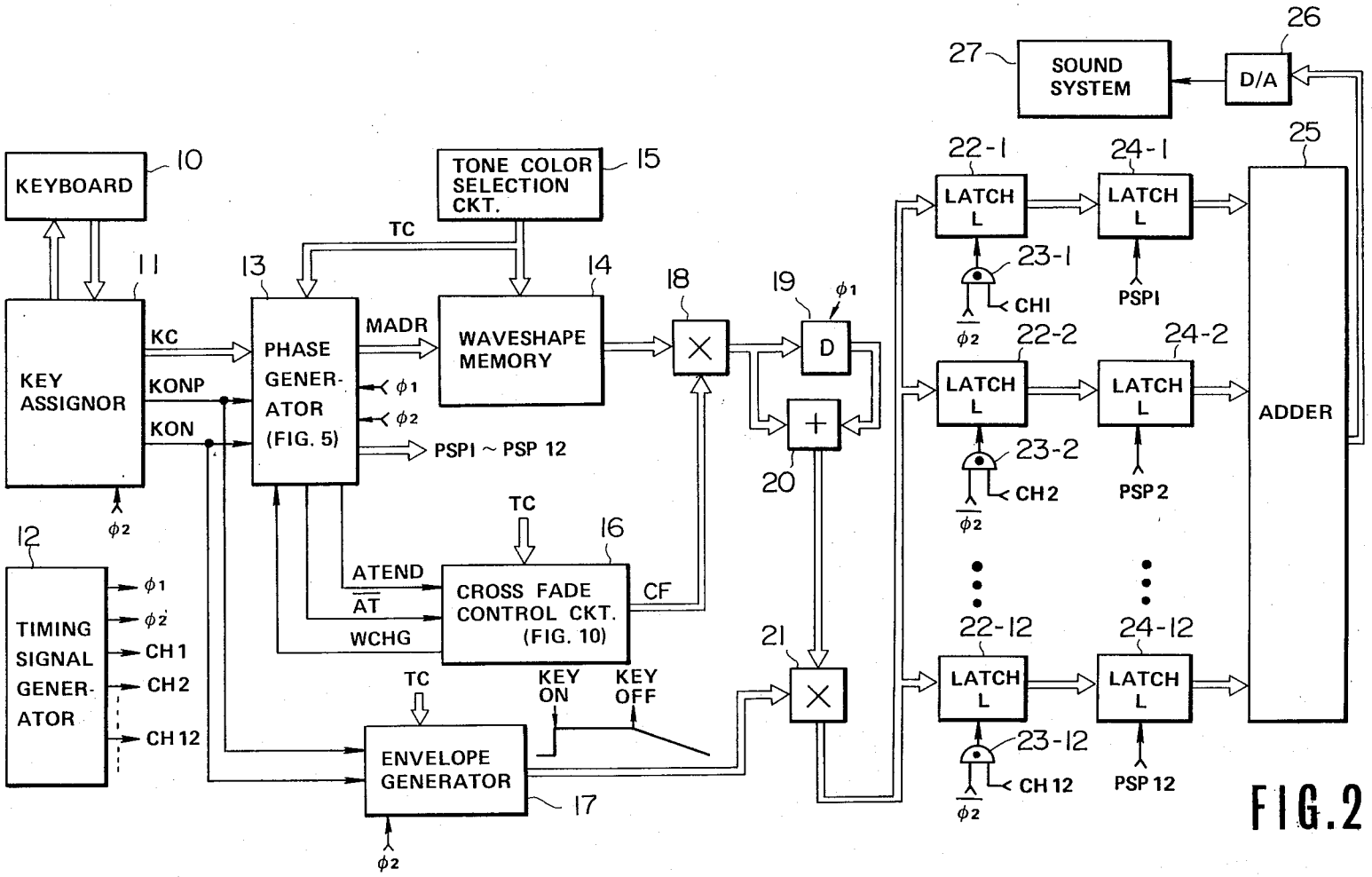
FIG. 2 is an electric block diagram showing an embodiment of the electronic musical instrument using the tone signal generation device according to the invention.

FIG. 2 shows an embodiment of electronic musical instrument to which the tone signal generation device according to the invention is applied. In this electronic musical instrument, the tone signal is produced according to the tone signal generation principle described above referring to FIGS. 1*a* and 1*b*.

In FIG. 2, a keyboard 10 has a number of keys for designating the pitch of the tone to be produced. A key assignor 11 detects the depression or release of the keys and assigns the depressed key to one of the plurality of tone generation channels. By way of example, at most twelve tones can be produced simultaneously, the key assignor 11 assigning the depressed key to one of the twelve channels. A key code KC which specifies the key assigned to a channel, a key-on signal KON which indicates whether or not the key assigned to the channel remains depressed and a key-on pulse signal KONP which is generated instantly at the beginning of the depression of the key are produced from the key assignor in the individual channels at a given time division timing.

Figure 3:
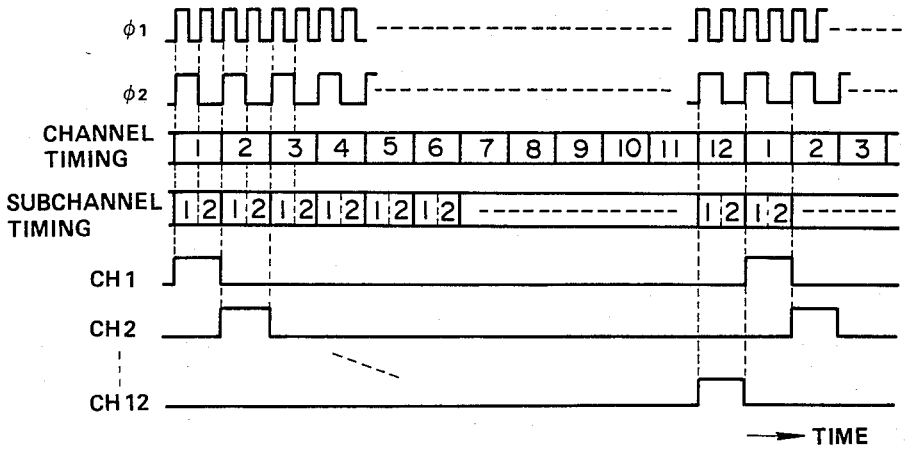
FIG. 3 is a time chart showing an example of a clock pulse and a channel timing signal used in this embodiment.

FIG. 3 shows an example of the time division timing. Individual channel timings 1 to 12 are produced in synchnism with a clock pulse $\phi_2$. Two subchannel timings 1 and 2 are produced by halving the time slots of the individual channel timings in synchronism with a clock pulse $\phi_1$ having twice the frequency as the clock pulse $\phi_2$. These subchannel timings 1 and 2 correspond to said first and second channels in the interpolation described. Thus according to this embodiment, the segment waveshapes of the first channel (subchannel 1) and the second channel (subchannel 2) for the interpolation are read in time division by halving one channel time slot. CH1 to CH12 denote channel timing signals generated in response to the respective channel timings 1 to 12. The clock pulses $\phi_1$, $\phi_2$ and the signals CH1 to CH12 are generated from a timing signal generator 12 and supplied to respective given circuits in the electronic musical instrument shown in FIG. 2.

A phase generator 13 is provided to designate a tone waveshape to be read out from a waveshape memory 14 and read out the tone waveshape according to a given tone frequency to be generated. The phase generator 13 generates address data MADR, which designates the sample points to be read, in time division in 24 time slots in each of the channels 1 to 12. The generator 13, in the construction of the invention, comprises reading means for repeatedly reading the one-period waveshape data from the waveshape memory means according to a given tone frequency to be generated and waveshape designating means for designating a tone waveshape to be read out from the waveshape memory means by switching as time passes. The phase generator 13 is supplied from the key assignor 11 with the key code KC, key-on pulse KONP and key-on signal KON, which designate the tone frequency to be generated and the sounding start timing.

Figure 4:
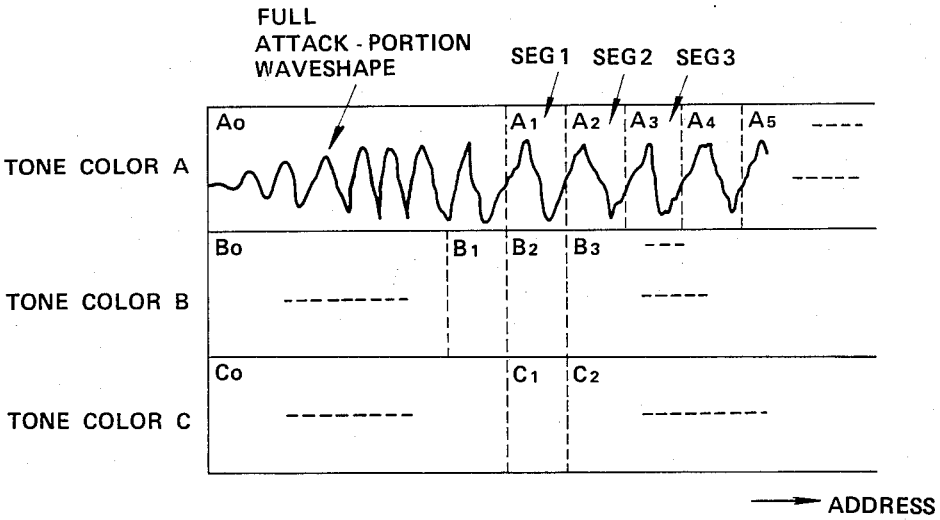
FIG. 4 shows an example of the memory map of a waveshape memory in the embodiment.

The waveshape memory 14 stores several sets of the full attack-portion waveshape and a plurality of segment waveshapes in correspondence to the tone colors. More specifically, as is well known, the memory 14 stores waveshape data corresponding to a plurality of sample points into which the waveshapes are divided (e.g., the waveshape amplitude data at these sample points). FIG. 4 schematically shows an example of the memory map in the waveshape memory 14. As to a tone color A, waveshape data of all the full attack-portion waveshape is stored in the address area from the address $A_0$ to $A_1-1$ and waveshape data for one period of the first waveshape SEG1 is stored in the address area from an address $A_1$ to $A_2-1$, and the segment waveshapes SEG2, SEG3, . . . are stored respectively in given address areas. Other tone colors B, C, . . . are stored in like manners. In FIG. 4, $A_0$, $A_1$, $A_2$, . . . , $B_0$, $B_1$, $B_2$, . . . , $C_0$, $C_1$, $C_2$, . . . denote the start addresses in the respective address areas, $A_0$, $B_0$, $C_0$, . . . denote the start address in the attack portion, $A_1$, $B_1$, $C_1$, . . . denote the start address of the first segment waveshape SEG1, and $A_2$, $B_2$, $C_2$, . . . denote the start address of the second segment waveshape SEG2. By way of example, one-period waveshape is sampled at 256 sample points and the full attack-portion waveshape has a maximum of 256 periods. As shown, the number of periods of the full attack-portion waveshape vary with the tone color. The sample points (256) in one period can be all expressed in decimal code using eight bits. Thus, the sample points in one period are specified by the least significant eight bits of the address data MADR. The least significant bits of the start addresses $A_0$, $A_1$, . . . , $B_0$, $B_1$, . . . , $C_0$, $C_1$, . . . are all "0" and the more significant bits have such values as are effective to designate the segment waveshapes. The segment waveshapes SEG1, SEG2, SEG3, . . . of various tone colors are compound waveshapes each containing the basic waveshape and the harmonics components. When the nonharmonics component is to be synthesized, at least one of the several components in one segment waveshape is out of phase by a given amount with that in the adjacent segment waveshapes.

Reverting to FIG. 2, a tone color selection circuit 15 produces and supplies tone color selection data TC to the phase generator 13, waveshape memory 14, cross fade control circuit 16, and an envelope generator 17. The cross fade control circuit 16 is provided to produce the interpolation functions for weighting the tone waveshape signals of the two channels (subchannels) related to the same sounding channel with the opposite characteristics. The cross fade control circuit 16 comprises part of interpolation means for weighting two waveshapes to be read out so that the preceding waveshape is switched smoothly to the following waveshape (especially the means for producing the interpolation function), counting means for producing the time function for setting the timewise change of weighting effected by the interpolation means, and means corresponding to the switching control means for controling the waveshape switching effected by the waveshape designating means in response to the output of the counting means.

The phase generator 13 supplies the cross fade control circuit 16 with an attack end signal ATEND which indicates that the full attack-portion waveshape has been read out and an inverted attack signal $\overline{AT}$ which indicates that the attack portion has not been read out yet. Upon checking the completion of reading of the attack portion based on these signals, the cross fade control circuit 16 starts producing a given interpolation function. The interpolation function is produced from the circuit 16 as cross fade curve data CF and supplied to a multiplier 18 provided for weighting operation. Also a waveshape switching command signal WCHG is produced from the circuit 16 and supplied to the phase generator 13.

The multiplier 18 for weighting operation forms part of the interpolation means together with an adder 20 which adds the output of said multiplier 18 to the signal obtained by delaying that output one period of the clock pulse $\phi_1$ through a delay circuit 19. From the waveshape memory 14 the tone waveshape data is read out in time division in synchronism with the respective subchannel timings of each channel. The cross fade control circuit 16 reads out the cross fade curve data CF in time division in synchronism with the respective subchannel timings of each channel. Thus in the multiplier 18, the tone waveshapes read out in time division in synchronism with the respective subchannels of each channel are weighted according to the respective cross fade curve data CF (i.e., interpolation functions). The adder 20 adds the two weighted subchannel tone waveshape data related to one tone generating channel. Specifically, when the first subchannel tone waveshape signal is supplied belatedly from the delay circuit 19 to the adder 20, the second subchannel tone waveshape data of the same channel is applied to the other input of the adder 20. Thus in the latter half of the time slot (corresponding to one period of the clock pulse $\phi_2$) of one channel, two weighted tone waveshape data related to that channel are mixed.

The envelope generator 17 generates the amplitude envelope waveshape signal in time division in each channel in response to the key-on signal KON and the key-on pulse KONP supplied from the key assignor 11. This envelope waveshape maintains a constant level while the key remains depressed and shows a decay envelope characteristics in response to the release of the key. The full attack-portion waveshape stored in the waveshape memory 14 has been previously provided with the attack envelope characteristics, which therefore need not be provided by the envelope generator 17 any more. The outputs of the adder 20 and the envelope generator 17 are applied to a multiplier 21 and the tone waveshape data of the respective channels are provided in time division with the amplitude envelopes corresponding to the depression and release of the key.

The output of the multiplier 21 is applied to the data inputs of latch circuits 22-1 to 22-12 provided in parallel in correspondence to the respective channels. The latch control inputs L of the latch circuits 22-1 to 22-12 are provided with the outputs of AND gates 23-1 to 23-12 being the logical products of the corresponding channel timing signals CH1 to CH12 and the inverted signal $\overline{\phi_2}$ of the clock pulse $\phi_2$. Thus the outputs of the adder 21 are latched in the corresponding latch circuits 22-1 to 22-12 in the latter halves of the time division time slots of each channel. As described, in the latter-half time slots (the timings of the subchannel 2) of the channel timings 1 to 12, two weighted tone waveshape data related to that channel are added by the adder 20 so that the data corresponding to the results of addition are latched in the respective latch circuits 22-1 to 22-12.

Thus the time division of the tone waveshape data of each channel is cleared.

The outputs of the latch circuits 22-1 to 22-12 are applied to latch circuits 24-1 to 24-12. The latch control inputs L of the latch circuits 24-1 to 24-12 are supplied with pitch synchronizing pulses PSP1 to PSP12 produced from the phase generator 13. The pitch synchronizing pulses PSP1 to PSP12 are pulses synchronizing with the frequencies of the tones assigned to the respective channels. Nonharmonic clock components are removed by latching the tone waveshape data in response to these pulses. The outputs of the latch circuits 24-1 to 24-12 are applied to and added by an adder 25 and then converted into an analog signal by a digital-to-analog converter 26 before reaching a sound system 27.

Figure 5:
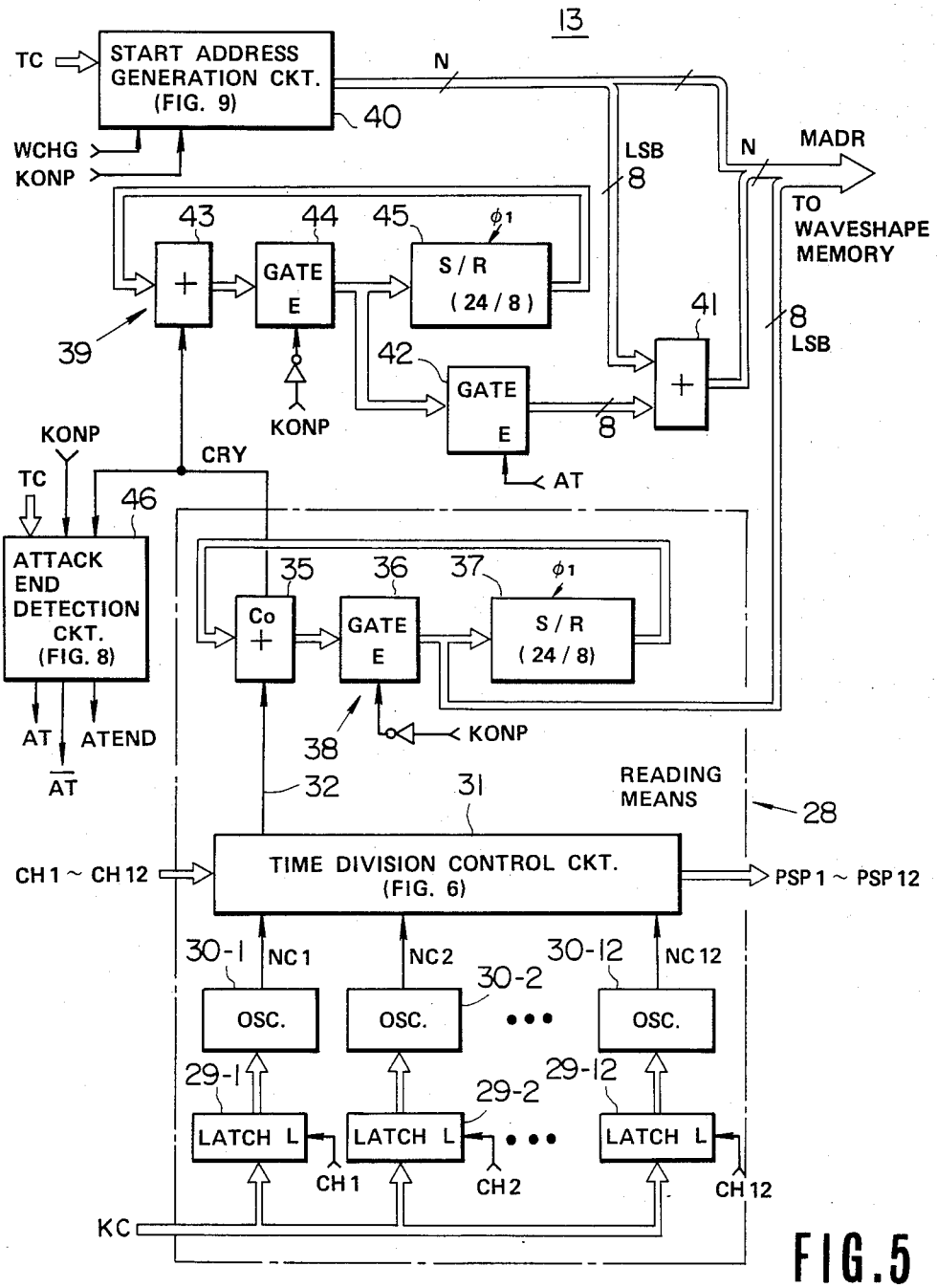
FIG. 5 is an electric block diagram showing an example of a phase generator shown in FIG. 2.

The individual parts of the circuit shown in FIG. 2 will now be described in detail. FIG. 5 shows an example of the phase generator 13. Numeral 28 denotes the reading means for repeatedly reading out one-period waveshape data. The key codes KC of the respective channels supplied in time division from the key assignor are applied to and latched in latch circuits 29-1 to 29-12 respectively in response to the channel timing signals CH1 to CH12. Variable oscillators 30-1 to 30-12 provided in the respective channels generate note clock pulses NC1 to NC12 corresponding to the tone frequencies of the depressed keys assigned to the respective channels in response to the key codes KC supplied from the corresponding latch circuits 29-1 to 29-12. The note clock pulses NC1 to NC12 are applied to a time division control circuit 31, sampled in time division in response to the channel timing signals CH1 to CH12, and multiplexed to obtain a time division multiplexed output through a line 32.

Figure 6:
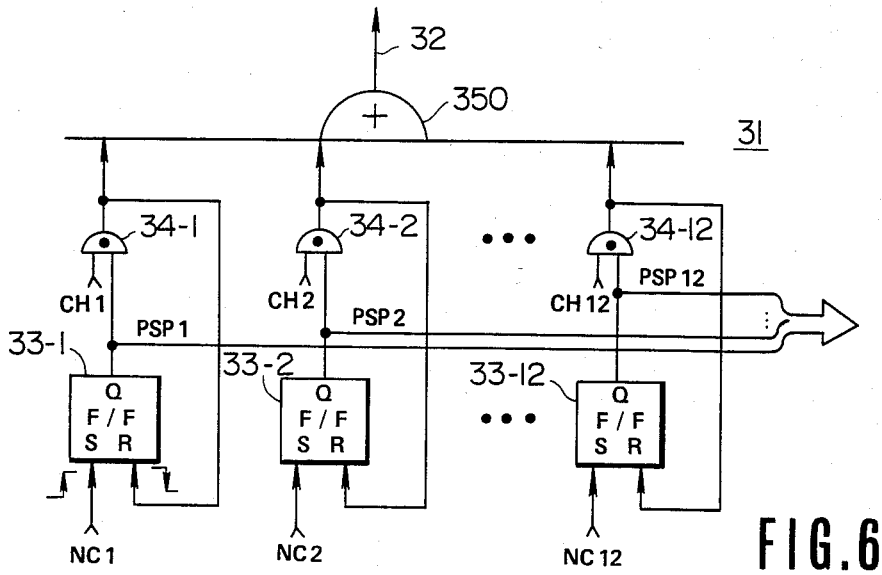
FIG. 6 is an electric block diagram showing a time division control circuit shown in FIG. 5.
Figure 7:
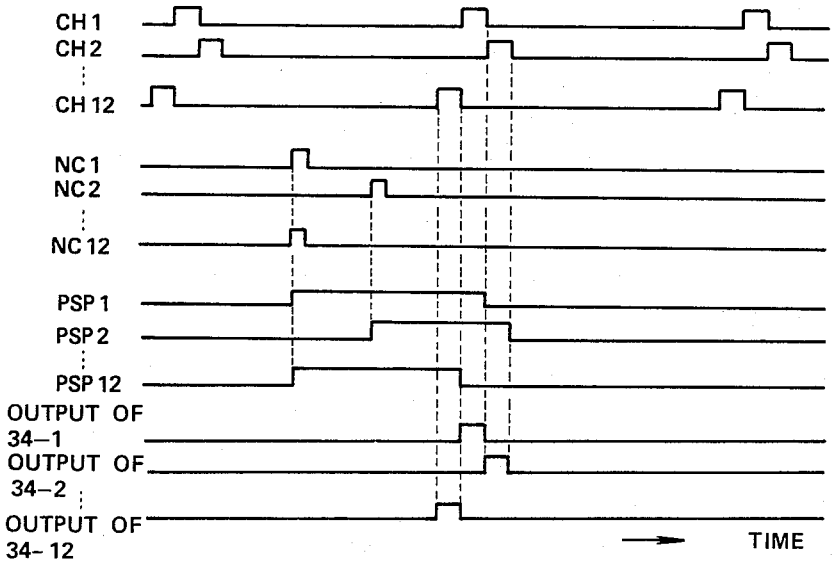
FIG. 7 is a timing chart showing an example each of various signals appearing in FIG. 6.

FIG. 6 shows an example of the time division control circuit 31, of which twelve RS flip-flops 33-1 to 33-12 are supplied through their set inputs S with the note clock pulses NC1 to NC12 respectively. AND gates 34-1 to 34-12 are supplied with the outputs Q of the flip-flops 33-1 to 33-12 and the channel timing signals CH1 to CH12. The outputs of the AND gates 34-1 to 34-12 are multiplexed by an OR gate 350 and led to the line 32 as well as returned to the reset inputs R of the corresponding flip-flops 33-1 to 33-12. The outputs of the flip-flops 33-1 to 33-12 are produced as the pitch synchronizing pulses PSP1 to PSP12 and, as described, applied to the latch circuits 24-1 to 24-12 shown in FIG. 2. The flip-flops 33-1 to 33-12 are set at the rise of the signals through the set inputs S and reset at the fall of the signals through the reset inputs R. FIG. 7 shows an example of the input and output signals at the various parts of the circuits shown in FIG. 6. As is clear from FIG. 7, the note clock pulses NC1 to NC12 of the keys assigned to the respective channels are asynchronous with the channel timings. The rise of the pulses NC1 to NC12 sets the flip-flops 33-1 to 33-12 so as to enable the AND gates 34-1 to 34-12. Then in response to the first channel timing signals CH1 to CH12, the AND gates 34-1 to 34-12 produce pulses, of which the fall resets the flip-flops 33-1 to 33-12. This makes it possible to obtain from the AND gates 34-1 to 34-12 new note clock pulses having the same frequencies as the note clock pulses NC1 to NC12 and synchronizing with the channel timing signals CH1 to CH12. Thus the note clock pulses corresponding to the frequencies of the tones assigned to the respective channels (having frequencies of integer times the frequencies of the tones) are provided to a line 32 in synchronism with the time division timings of the corresponding channels.

Reverting to FIG. 5, the note clock pulses of the respective channels are applied to a counter 38 consisting of an adder 35, a gate 36 and a shift register 37 so the pulses are counted channelwise in time division. The shift register 37, comprising 24 bits/8 stages, is shift controlled by the clock pulse $\phi_1$ synchronizing with the subchannel timing. The output of the shift register 37 is applied to the adder 35 so as to be added with the note clock pulse through the line 32. The addition output is stored through the gate 36 in the shift register 37. The 24 stages of the shift register 37 correspond to the two subchannels of the twelve channels respectively so that the counts for one channel are stored in two stages (corresponding to the two subchannels) respectively. The 36 is instantly closed in response to the key-on pulse KONP immediately before the start of sounding to clear the memory for the corresponding two stages in the shift register 37.

The shift register 37 has a capacity of eight bits per one stage so that the counter 38 carries out a modulo 256 counting in time division for 24 channels (in fact 12 channels). The output of the gate 36 is taken out as the count output of the counter 38 and applied to the waveshape memory 14 as the least significant bits of the address data MADR. This count output of the counter 38 makes it possible to sequentially read out the sample points of the one-period waveshape consisting of 256 sample points. The counting is carried out according to the note clock pulses NC1 to NC12 so that said reading is effected correspondingly to the tone frequencies to be generated.

The address data MADR for reading out the waveshape memory 14 includes $N+8$ bits ($N>8$). As mentioned, its least significant eight bits sequentially designate the sample points in one period of the waveshape and the most significant N bits designate the waveshape for one period.

The address data of the most significant N bits for designation of the waveshape is supplied from a start address generation circuit 40 being the waveshape designation means through an adder 41. The start address generation circuit 40 generates the start addresses $A_0$, $B_0$, $C_0$, . . . of the full attack-portion waveshape and the start addresses $A_1$, $A_2$, . . . of the segment waveshapes. To designate each one-period waveshape of the full attack-portion waveshape, there is provided an attack-portion period counter 39. An adder 41 is provided to specify the absolute addresses of the individual one-period waveshapes in the entire attack-portion waveshape by addition and synthesis of the outputs of the counter 39 and the start addresses $A_0$, $B_0$, $C_0$, . . . of the attack portion.

The attack-portion period counter 39 has a hardware construction similar to the counter 38 and comprises an adder 43, gate 44 and a shift register 45. The counter 39 counts a carry-out signal CRY from the most significant bit of the adder 35 channelwise in time division. The carry-out signal CRY is generated each time 256 shots of the note clock pulse are counted in a certain channel of the counter 38 (i.e., each time one period of the waveshape is read out). Counting the carry-out signal CRY means counting the frequency of the attack portion.

The output of the counter 39 is applied to the gate 42, which is opened in response to an attack signal AT to be described later only during the reading of the full attack-portion waveshape, when the output of the counter 39 is applied to an adder 41. The other input of the adder 41 is supplied with the outputs of the least significant eight bits of the N-bit start address data generated from the start address generation circuit 40. The 8-bit output data of the adder 41 is positioned on the less significant side of the most significant (N-8)-bit data of the N-bit start address data,both data forming the most significant N bits of the address data MADR. The count by the counter 39 indicates the number of periods as counted from the first period of the full attack-portion waveshape while the start address $A_0$, $B_0$, $C_0$, . . . indicates the first absolute address of said full attack-portion waveshape in the waveshape memory 14. Therefore, by addition of the count and start address, the first absolute address of each period of the full attack-portion waveshape can be specified (or the individual one-period waveshapes can be designated).

Figure 8:
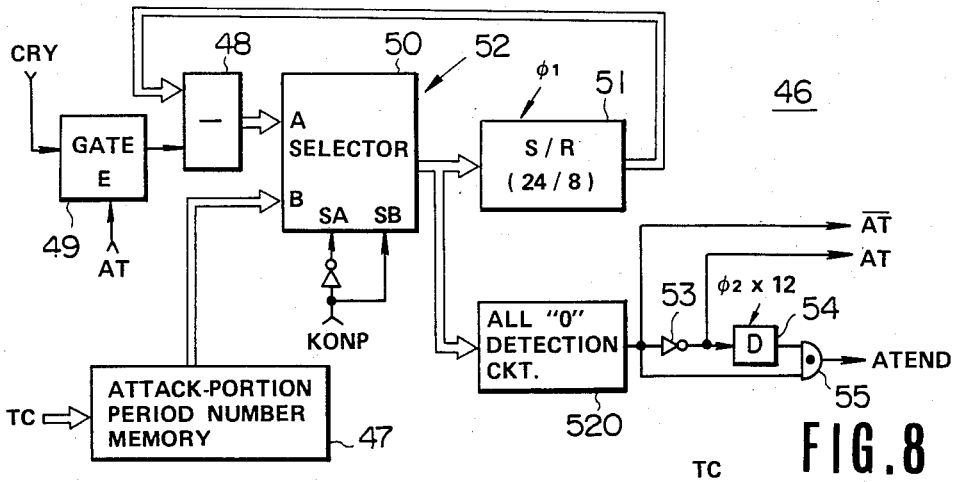
FIG. 8 is an electric block diagram showing an example of an attack end detection circuit shown in FIG. 5.

An attack end detection circuit 46 is provided to count the carry-out signal CRY supplied from the counter 38 and check whether the reading of the entire attack-portion waveshape is completed. FIG. 8 shows an example of the circuit 46.

In FIG. 8, an attack-portion period number memory 47 stores the number of periods of the full attack-portion waveshape for each tone color and reads out the period number data ATN according to tone color selection data TC. A counter 52 formed of a subtractor 48, gate 49, selector 50, and a 24-stage/8-bit shift register 51 performs downcounting of the number of periods each time one period of the attack portion waveshape is read out. The downcounting is carried out channelwise in time division. The selector 50 selects the period number data ATN read from the memory 47 through its B input upon generation of the key-on pulse KONP and loads the data in the shift register 51. At other times, the selector 50 selects the data applied to its A input from the last stage of the shift register 51 through the subtractor 48 and supplies the data to the shift register 51. The carry-out signal CRY produced by the adder 35 shown in FIG. 5 is applied to the gate 49. The gate 49 is enabled by the attack signal AT during the attack to provide the carry-out signal CRY to the subtractor 48. Upon receipt of the carry-out signal CRY, the subtractor 48 subtracts "1" from the output data of the shift register 51. Thus, the data indicating the number of periods of the full attack-portion waveshape is first applied to the shift register 51, thereafter "1" being subtracted from said data each time one period of the attack portion waveshape is read out until finally the reading of the full attack-portion waveshape is completed.

Figure 11:
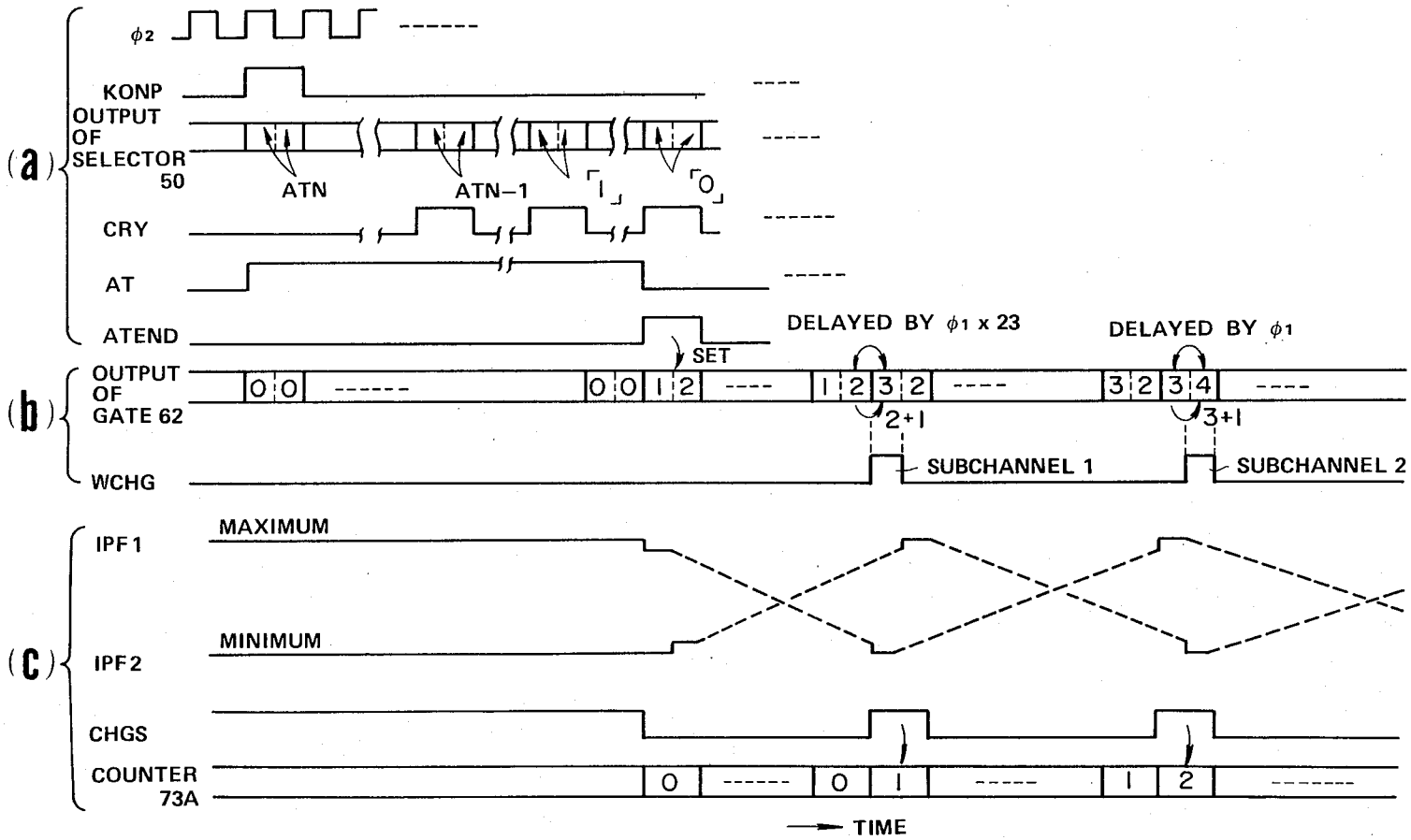
FIG. 11 is a time chart showing an example each of various signals appearing in FIGS. 8, 9 and 10.
Figure 12A:
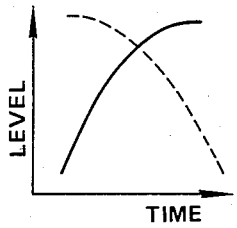
FIGS. 12*a*–12*e* are schematic views showing various interpolation functions (cross fade curves) prepared in a cross fade curve memory shown in FIG. 10.
Figure 12B:
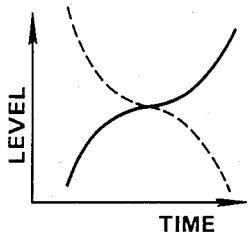
Figure 12C:
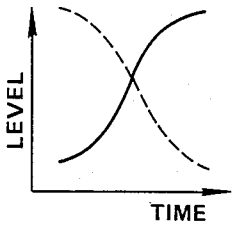
Figure 12D:
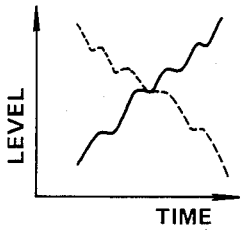
Figure 12E:
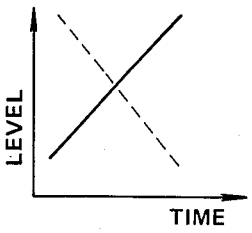

The output of the counter 52 is taken out from the selector 50 and applied to an all-"0" detection circuit 520. The all-"0" detection circuit 520 detects whether the count output data supplied from the selector 50 is all 0s and produces "1" when the data is all 0s. The output signal of the detection circuit 520 is produced as an inverted attack signal $\overline{AT}$. The signal obtained by inverting the inverse attack signal $\overline{AT}$ through an inverter 53 is produced as the attack signal AT. Accordingly, the attack signal AT is "1" and the inverse attack signal $\overline{AT}$ is "0" during the attack, the former going to "0" and the latter "1" upon termination of the attack. A delay circuit 54 is provided for providing the signal delay corresponding to one period of the time division channel timing according to the clock pulse $\phi_2 \times 12$ having 12 times the number of periods of the clock pulse $\phi_2$ and delays the attack signal AT before supplying it to an AND gate 55. The AND gate 55 is supplied through its other input with the inverted attack signal $\overline{AT}$. When the signal $\overline{AT}$ is switched from "0" to "1", the output of the AND gate is turned to "1" during one time slot corresponding to the channel (two time slots of the subchannel), which output "1" is produced as the attack end signal ATEND. Upon termination of the attack, the gate 49 is closed in response to "0" of the attack signal AT so that no further downcounting is effected. Therefore, the count given by the counter 52 maintains "0" at all times but during the attack. FIG. 11, part (*a*) shows an example of the operation of the circuits shown in FIG. 8.

Reverting to FIG. 5, the start address generation circuit 40 selects one set of start addresses according to the tone color selection data TC, generates the start address of the attack portion according to the key-on pulse KONP and generates the start addresses of the respective segment waveshapes, by switching one for another, according to the waveshape switching command signal WCHG. An example of the start address generation circuit 40 is shown in FIG. 9.

Figure 9:
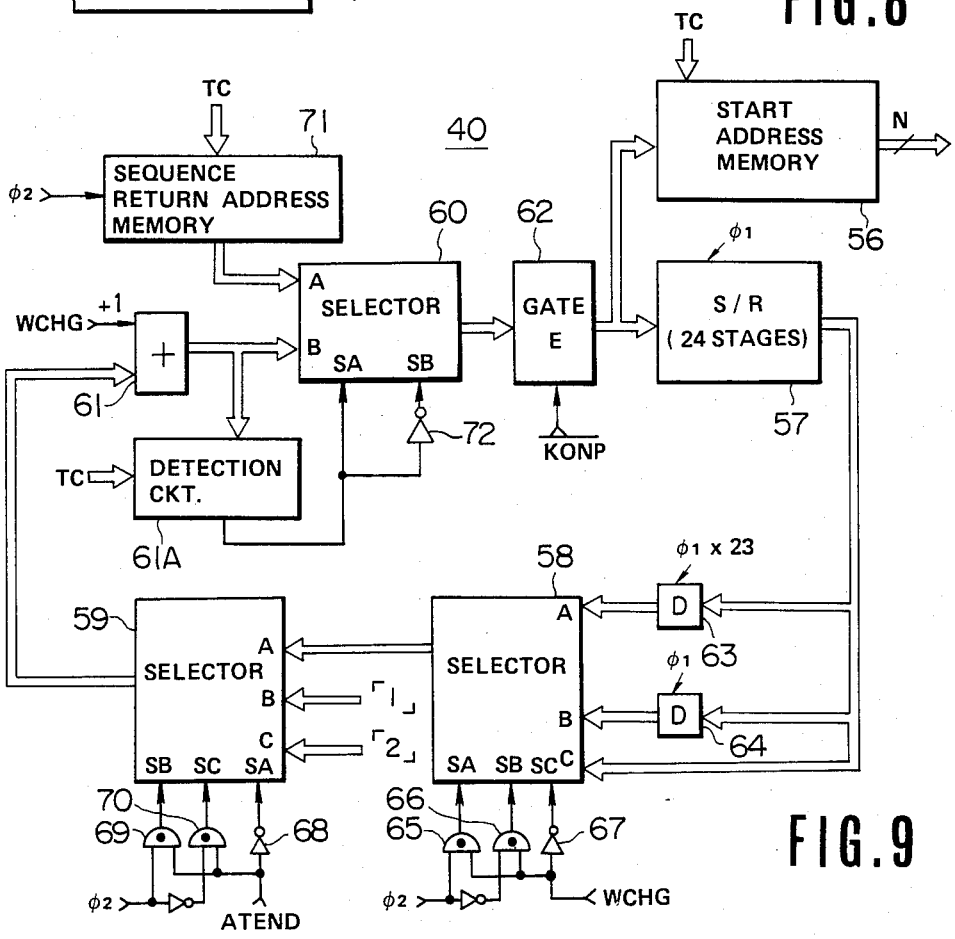
FIG. 9 is an electric block diagram showing an example of a start address generation circuit shown in FIG. 5.

In FIG. 9, more than one set of start addresses $A_0$, $A_1$, $A_2$, . . . , $B_0$, $B_1$, $B_2$, . . . , $C_1$, $C_2$, . . . are stored in a start address memory 56 in correspondence to the respective tone colors. One of these start addresses (e.g., $A_0$, $A_1$, $A_2$, . . . for the tone color A) is selected according to the tone color selection data TC. The loop comprising a 24-stage shift register 57, selectors 58, 59, 60, adder 61 and a gate 62 forms a counter. The count taken out from the gate 62 is applied to the address of the start address memory 56. The start address memory 56 reads out the selected one set of start address data (e.g., $A_0$, $A_1$, $A_2$, . . . ) sequentially according to the count supplied to the address input. Specifically, the start address memory 56 reads out the start address $A_0$ of the attack portion in response to the count "0" supplied from the gate 62, the start address $A_1$ of the segment waveshape SEG1 in response to the count "1", and the start address $A_2$ of the segment waveshape SEG2 in response to the count "2". Thus the waveshape to be read from the waveshape memory 14 (FIG. 2) is designated by the start address data read from the start address memory 56.

The gate 62 is enabled by the signal $\overline{KONP}$, the inverse of the key-on pulse KONP. The gate 62 is closed in the channel in which the key-on pulse is generated so that the memory in the shift register 57 corresponding to that channel is cleared. The output of the last stage of the shift register 57 is applied to the C input of a selector 58 as well as to the A input and the B input of the selector 58 through delay circuits 63 and 64 respectively. The delay circuit 63 is delay-controlled by the clock pulse $\phi_1 \times 23$ corresponding to 23 periods of the clock pulse $\phi_1$ while the delay circuit 64 is delay-controlled by the clock pulse $\phi_1$. The A selection input SA of the selector 58 is supplied with the output of an AND gate 65 being the logical product of the clock pulse $\phi_2$ and the waveshape switching demand signal WCHG. The B selection input SB is supplied with the output of an AND gate 66 being the logical product of the inverse of the clock pulse $\phi_2$ and the signal WCHG. The C selection input SC is supplied with the inverse of the signal WCHG from an inverter 67.

The output of the selector 58 is applied to the A input of a selector 59. The B input of the selector 59 is supplied with the numerical value "1" and the C input with "2". The A selection input SA of the selector 59 is supplied with the inverse of the attack end signal ATEND from an inverter 68, the B selection input SB with the output of an AND gate 69 being the logical product of the clock pulse $\phi_2$ and the signal ATEND, and the C selection input SC with the output of an AND gate 70 being the logical product of the inverse of the clock pulse $\phi_2$ and the signal ATEND.

The output of the selector 59 is applied to an adder 61. The other input of the adder 61 is supplied with the waveshape switching command signal WCHG so that the output data of the selector 59 is added with "1" each time the command signal WCHG is turned to "1". The output of the selector 61 is applied to the B input of a selector 60. The A input of the selector 60 is supplied with the output of a sequence return address memory 71. The output of the adder 61 is applied to a final segment detection circuit 61A of which the output signal is supplied to the A selection input SA of the selector 60. The inverse of the output signal of said circuit 61A is supplied through an inverter 72 to the B selection input SB. The output of the selector 60 is applied through a gate 62 to the shift register 57.

Because the shift register 57 has 24 stages and the clock pulse $\phi_1$ is used as the operation clock pulse, the count operation is performed in 24 time slots in time division in each of the subchannel of the channels 1 to 12. The count operation in one channel will be described below. As previously described, the gate 62 is closed first upon generation of the key-on pulse KONP, clearing the contents of the two stages of the shift register 57 to all 0s. As will be described later, the waveshape switching command signal WCHG is not generated during the attack and therefore the selector 58 always selects the C input. The attack end signal ATEND remains "0" during the attack and the selector 59 selects the A input. Further, the output signal of the final segment detection circuit 61A remains "0" until the reading of the final segment waveshape is completed so that the selector 60 selects the B input. Thus the cleared contents of the shift register 57 circulate through the C input of the selector 58, the A input of the selector 59, the adder 61, the B input of the selector 60 and the gate 62, with a time delay of one cycle of the channel timing in synchronism with the same channel timing. Therefore, the count supplied from the gate 62 to the start address memory 56 maintains "0" and, accordingly, the data indicating the start address of the attack portion (e.g., $A_0$) is read out.

As described, the attack end signal ATEND is generated once upon termination of the attack by the attack end detection circuit 46 shown in FIG. 8 at the pertinent channel timing (time slots for two subchannels). This enables the AND gates 69 and 70 so that the selector 59 selects the B input at the first-half time slot (i.e., the timing of the subchannel 1 at which the clock pulse $\phi_2$ is turned to "1") and the numerical value data "1" is stored in the shift register 57. Further, the selector 59 selects the C input at the second-half time slot (i.e., the timing of the subchannel 2 at which the clock pulse $\phi_2$ is turned to "0") and the numerical value data "2" is stored in the shift register 57.

Thus, after the attack ends, first the numerical value data "1" is set in correspondence to the subchannel 1 and the numerical value data "2" is then set in correspondence to the subchannel 2. Accordingly, the start address memory 56 reads out data indicating the start address (e.g., $A_1$) of the first segment waveshape SEG1 in correspondence to the subchannel 1 and data indicating the start address (e.g., $A_2$) of the second segment waveshape SEG2 in correspondence to the subhcannel 2. This state is maintained until the waveshape switching command signal WCHG is subsequently supplied. FIG. 11 part (*b*) shows, by way of example, the change of the count for one channel (two subchannels) produced from the gate 62.

The waveshape switching command signal WCHG is generated so as to correspond alternately to one of the two subchannels of the same channel, as will be described. As shown in FIG. 11, part (*b*), the signal WCHG corresponds to the subchannel 1 and then to the subhcannel 2, thus corresponding alternately to either subchannel thereafter. Therefore, the count operation in the circuit shown in FIG. 9 in response to the waveshape switching command signal WCHG is performed for one of the two subchannels.

When the waveshape switching command signal WCHG is generated in correspondence to the first-half channel time slot, i.e., the subchannel 1, the AND gate 65 is enabled in response to "1" of the clock pulse $\phi_2$ while the AND gate 66 is not enabled. In this case, therefore, the output of the delay circuit 63 is selected through the A input of the selector 58, to which output "1" is added by the adder 61 in response to the signal WCHG. The delay circuit 63 produces data 23 time slots ahead in terms of subchannel timing. This data is the count data of the subchannel 2 in the preceding cycle related to the same channel. The count of the subchannel 2 as added with "1" is the new count. In this case, since the count of the subchannel 2 is greater than that of the subchannel 1 by 1, it is as if the count of the subchannel 1 were added with 2. For instance when, as mentioned, the count of the subchannel 1 is "1" and the count of the subchannel 2 is "2", the count "2" in the previous cycle (i.e., the output of the delay circuit 63) is added with 1 at the timing of the subchannel 1 when the first waveshape switching command signal WCHG is provided in correspondence to the subchannel 1, thus the count of the subchannel 1 changing to "3". In this case, the output of the shift register 57 is selected as it is through the C input of the selector 58 at the timing of the subchannel 2 so that the count is not increased and the count of the subchannel 2 remains "2". Thus the read address of the subchannel 1 changes in response to the first waveshape switching command signal WCHG and the data indicating the start address (e.g., $A_3$) of the third segment waveshape SEG3 is read out from the memory 56. In the meantime, the read address of the subchannel 2 remains unchanged so that the start address data of the second segment waveshape SEG2 continues to be read out.

When the waveshape switching command signal WCHG is generated in correspondence to the subchannel 2, the AND gate 66 is enabled, conversely to the above case, so that the output of the delay circuit 64 is selected through the B input of the selector 58 and added with 1 by the adder 61 in response to the signal WCHG. The delay circuit 64 meantime produces the count of the subchannel one time slot ahead, i.e., the subchannel 1 of the same channel, which count, as added with 1, is the new count of the subchannel 2. In this case, the count of the subchannel 1 is greater than that of the subchannel 2 so that the subchannel 2 acquires the same count as if it were added with 2. For instance, upon generation of the signal WCHG in correspondence to the subhcannel 2 when, as described, the count of the subchannel 1 is "3" and the count of the subchannel 2 is "2", the count of the subchannel 2 changes to "4" while the count of the subchannel 1 remains "3".

As described above, each time the waveshape switching command signal WCHG is generated alternately in correspondence to one of the subchannels 1 and 2, the count of the corresponding subchannel increases by 2 and, accordingly, the order of the segment waveshapes designated in the respective subchannels changes alternately at every other timing as "1" and "2", "3" and "2", "3" and "4", "5" and "4". This alternate waveshape switching control enables assignment of the segment waveshapes as shown in FIG. 1*b* corresponding to both channels (subchannels 1 and 2) to be realized.

When a given number of waveshape switching command signal WCHG have been supplied and the output of the adder 61 has exceeded the value designating the last segment waveshape, the output signal of the last segment detection circuit 61A is turned to "1". The detection circuit 61A is formed, for instance, of a memory and a comparator, the memory storing the numerical value for each tone color designating the last segment waveshape of the plurality of segment waveshapes stored in the waveshape memory 14 in respect of each tone color and reading out the numerical value according to the tone color selection data TC, the comparator comparing the numerical data read out from the memory and the output data of the adder 61 and producing the signal "1" when the value of the output data is greater than the value of the numerical value data. When the output signal of the detection circuit 61 is turned to "1", the selector 60 is switched to select the A input selection. Accordingly, the return address order data read out from the sequence return address memory 71 is selected by the selector 60 and stored in the shift register 57. In the sequence return address memory 71 is stored in respect of the subchannels 1 and 2 for each tone color the return address order data indicating which segment waveshape should be read out subsequent to the last segment waveshape. The memory 71 reads out a given return address order data in response to the tone color selection data TC and the clock pulse $\phi_2$. In case the sounding continues after the last segment waveshape is read out, the sequence return address memory 71 is provided to ensure that the reading be continued returning to the segment waveshape corresponding to the return address order data. In this case, the return address order data stored in the sequence return address memdory 71 is the numerical value i indicating the order of the segment waveshape SEGi to which is read out upon return in correspondence to the subchannel 1 and the numerical value i+1 indicating the order succeeding said segment waveshape SEGi in correspondence to the subchannel 2 in respect of the tone colors of which the total number of the sequence waveshapes SEG1, SEG2, . . . stored in the waveshape memory 14 is an even number. In respect of the tone colors of which the total number of said sequence waveshapes is an odd number, there is stored in the waveshape memory 14 the numerical value i in correspondence to the subchannel 2 and the numerical value i+1 in correspondence to the subchannel 1 conversely to the above case.

When, for instance, the tone color A is selected, supposing the total number of its segment waveshapes is 6, and the order of the segment waveshape to be returned to for reading is 3, the count of the subchannel 1 changes as "0"→"1"→"3"→"5"→"3"→"5"→"3"→"5" . . . while the count of the subchannel 2 changes as "0"→"2"→"4"→"6"→"2"→"6"→"2"→"6" . . . . Consequently, the segment waveshapes SEG3, SEG5 are designated repeatedly after the segment waveshapes SEG1, SEG3 and SEG5 are designated sequentially in respect of the subchannel 1 while the segment waveshapes SEG4, SEG6 are designated repeatedly after the segment waveshapes SEG2, SEG4, SEG6 are designated sequentially.

The cross fade control circuit 16 will now be described below referring to FIG. 10.

Counting means 73 is provided to generate the time function for setting the timewise change of the weighting and comprises a first counter 73A and a second counter 73B. The counters 73A and 73B respectively comprise adders 74A, 74B, gates 75A, 75B and 12-stage shift registers 76A, 76B controlled by the clock pulse $\phi_2$. The outputs of the shift registers 76A, 76B circulate through the adders 74A, 74B and gates 75A, 75B so as to enable a channelwise count operation in time division. The first counter 73A is provided to count the number of times the segment waveshapes are switched. A change rate memory 77 has the change rate data according to the number of the switchings stored for the respective tone colors. According to the tone color selection data TC, one set of the change rate data is selected and one change rate data DT is further selected from among the selected data according to the number of switchings counted by the first couner 73A. The output of the gate 75A is taken out as the count output of the counter 73A and applied to the memory 77. The first counter 73A and the change rate memory 77 correspond to the counting rate control means.

The second counter 73B is provided to perform the counting of a first given value (e.g., 0) through a second given value (e.g., a maximum) at the rate according to the change rate data DT read out from the memory 77. The change rate data DT is applied to the adder 74B and accumulated in the second counter 73B at given time intervals. The gate 75B is enabled by the inversed attack signal $\overline{AT}$ except during the attack. During the attack, therefore, the count of the counter 73B is cleared to "0" until it starts counting the data DT upon termination of the attack.

The count output of the second counter 73B is taken out from the gate 73B and applied to a function conversion circuit 78 consisting of exclusive OR gates. The function conversion circuit 78 accepts the least significant n-1 bits of the n-bit count output separately through its exclusive OR gates and the most significant bit MSB through its individual OR gates in common so as to pass the least significant n-1 bits as they are when MSB is "0" but pass the least significant n-1 bits as inverted when MSB is "1". Thus the count increasing from the minimum 0 up to the maximum $2^n$ is folded at $2^{n-1}$ so that the function assumes a form of a triangular wave increasing from 0 to $2^{n-1}$ and decreasing from $2^{n-1}$ to 0.

The output of the function conversion circuit 78 is used as a basic interpolation function IPF2 for the second channel (subchannel 2). An inversion circuit 79 is provided to produce another function of the opposite characteristic by inverting each bit of the interpolation function IPF2. This function of the opposite characteristics is the basic interpolation function IPF1 for the first channel (subchannel 1). FIG. 11, part (*c*) shows an example of these interpolation functions IPF1, IPF2. During the attack, the output of the function conversion circuit 78 is all 0s because the output of the second counter 73B is all 0s so that the value of the second-channel interpolation function IPF2 maintains the minimum (0) while the first-channel interpolation function IPF1 maintains the maximum.

A selector 80 is provided to time division multiplex the interpolation functions IPF1, IPF2 in synchronism with the subchannels 1 and 2, of which the A input is supplied with IPF2 and the B input with IPF1, selecting IPF1 through the B input in response to the clock pulse $\phi_2$ in the "1" state (the time slot of the subchannel 1) and IPF2 through the A input in response to the clock pulse $\phi_2$ in the "0" state (at the time slot of the subchannel 2).

Switching control means 81 is provided to control the waveshape switching operation by the waveshape designation means or the start address generation circuit 40 shown in FIG. 9 according to the output of the counting means 73 and comprises an all-"0" detection circuit 82 and an AND gate 83, the detection circuit 82 detecting the all-"0" state of the interpolation functions IPF1, IPF2 produced from the selector 80, the AND gate 83 being supplied with the output of the detection circuit 82 and the inverted attack signal $\overline{AT}$. The AND gate 83 is enabled by the signal $\overline{AT}$ except during the attack to produce the output signal "1" of the all-"0" detection circuit 82 as the waveshape switching command signal WCHG. When one of the two subchannel interpolation functions IPF1, IPF2 having a negative slope or gradually decreasing with time is turned to all 0s, the output of the all-"0" detection circuit 82 is turned to "1" at the timing corresponding to that subchannel and, accordingly, the waveshape switching command signal WCHG is generated. Since the slopes of the interpolation functions IPF1, IPF2 of both subchannels change at every interpolation section, the waveshape switching command signal WCHG is generated in correspondence to one of the subchannels alternately each time one interpolation is completed. FIG. 11, part (*b*) shows an example of the waveshape switching command signals WCHG as generated in correspondence to the interpolation functions IPF1 and IPF2 shown in FIG. 11, part (*c*).

The interpolation functions IPF1, IPF2 produced in time division from the selector 80 show a timewise linear characteristic. A cross fade curve memory 84 corresponding to the interpolation function memory means is provided to convert the characteristics of these functions into desired ones. For instance, various interpolation characteristics curves (weighting curves), as shown in FIGS. 12*a*–12*e* by solid lines, are stored in correspondence to various tone colors in the memory 84. One of these curves is selected according to the tone color selection data TC (or by means of a special switch, etc.) and read out with the interpolation functions IPF1, IPF2 as addresses. As described previously, since the interpolation functions IPF1, IPF2 of both subchannels (these are, so to speak, basic interpolation functions) possess opposite characteristics to each other, the direction of the reading from the memory 84 for one of the subchannels is opposite to that for the other subchannel so that curves of opposite characteristics are read out in time division from the memory 84. For instance, when interpolation characteristics curves as shown by solid lines in FIGS. 12A–12*e* are read out in correspondence to one of the subchannels, interpolation characteristics curves as shown by dotted lines in said figure are read out in correspondence to the other subchannel.

As described above, the interpolation characteristics curve data corresponding to each subchannel of each channel read out in time division from the memory 84 is supplied as cross fade curve data CF to the multiplier 18 shown in FIG. 2 for providing the corresponding segment waveshape data with weighting (amplitude control) according to the characteristics. Since the functions IPF1, IPF2 are used as address signals in the memory 84, the counting means 73 and the function conversion circuit 78 act as the address generation means for the memory 84.

Such use of the memory 84 enables the interpolation characteristics to possess desired curves. Further, since the interpolation characteristics of the two channels are obtained by reading out any interpolation characteristics curves in the opposite directions to each other, desired interpolation characteristics curves can be provided and yet symmetrical interpolations are effected eventually without fail (as far as the interpolation synthesis on two channels is concerned) so that impartial and smooth interpolation can be obtained. As for the characteristics shown in FIGS. 12*a*–12*b* the volume increases at the middle of the interpolation (at the middle of the tone waveshape change) according to the characteristic shown in FIG. 12*a* while the waveshape changes greatly at first, mildly halfway and greatly again at the end according to the characteristic shown in FIG. 12*b*. The waveshape changes mildly at the beginning and at the end and greatly at the middle according to the characteristic shown in FIG. 12*c*. The waveshape change swings according to the characteristic shown in FIG. 12*d*.

Figure 10:
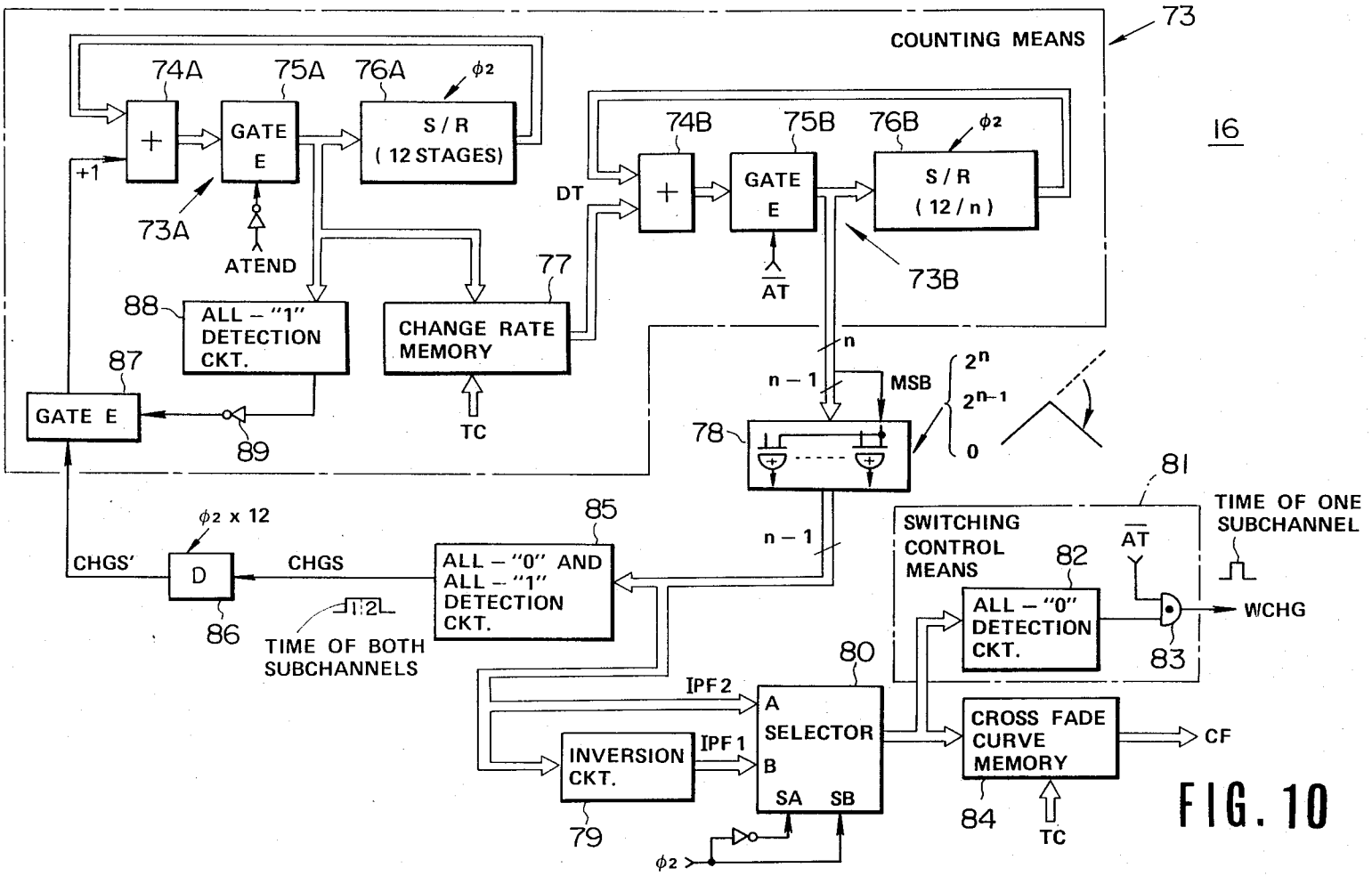
FIG. 10 is an electric block diagram showing an example of a cross fade control circuit shown in FIG. 2.

Reverting to FIG. 10, an all-"0" and all-"1" detection circuit 85 is provided to produce the switching synchronizing signal CHGS in synchronism with the waveshape switching timing. The detection circuit 85 is provided with the output of the function conversion circuit 78, i.e., the interpolation function IPF2 and detects whether the value of the input is all 0s or all 1s. As will be obvious from FIG. 11, part (*c*), the interpolation function IPF2 changing in the form of a triangular wave is all 1s at its upper apexes and all 0s at its lower apexes, these apexes synchronizing with the waveshape switching timing, i.e., the timing of the waveshape switching command signal WCHG. The switching synchronizing signal CHGS is turned to "1" when the interpolation function is either all 0s or all 1s. The signal CHGS is turned to "1" at the time slots of both channels, i.e., at the time slots for one channel corresponding to one period of the clock pulse $\phi_2$.

The signal CHGS is delayed one cycle of the time division channel timing by the delay circuit 86 according to the clock pulse $\phi_2 \times 12$ and supplied to the adder 74A in the counter 73A through the gate 87. The output of the adder 74A is supplied through the gate 75A to the 12-stage shift register 76A and delayed one cycle of the time division channel timing before being returned to the input of the adder 74A. The gate 75A is controlled by the inverse of the attack end signal $\overline{ATEND}$ and is cleared instantly upon generation of the attack end signal ATEND to clear the memory of the shift register 76A related to the corresponding channel. As described before, the output of the gate 75A is supplied to the change rate memory 77 as well as to the all-"1" detection circuit 88. The all-"1" detection circuit 88 produces the signal 1 when the count of the counter 73A is turned to all 1s or assumes its maximum. The inverse of this output signal is supplied through an inverter 89 to the control input of a gate 87.

During the attack, the count of the counter 73A maintains a maximum and the gate 87 is closed. When the count is cleared in response to the attack end signal ATEND upon termination of the attack, the output of the all-"1" detection circuit 88 is turned to "0" and the gate 87 is opened. Thereafter the count of the counter 73A increases each time the switching synchronizing signal CHGS is generated to count how many times the switchings of waveshapes were effected. When the count reaches a maximum (all 1s), the gate 87 is closed to stop the count operation. The delay circuit 86 is provided to delay the timing at which the signal CHGS is applied to the counter 73A by a time delay between the input and output in the shift register 76A. FIG. 11, part (c) shows an example of the number of switchings effected by the synchronizing signal CHGS and the counter 73A.

From the change rate memory 77, as mentioned before, given change rate data DT is readout according to the count of the counter 73A. Based on the change rate data DT, the increase rate of the count by the second counter 73B is determined, the slopes of the interpolation functions IPF1, IPF2 fixed and, accordingly, the time length of one interpolation section ($t_1$, $t_2$, $t_3$, $t_4$, . . . as shown in FIG. 1*b*) is determined. Since any change rate data DT can be set in the memory 77 according to the number of the waveshape switchings effected (i.e., in each interpolation section), the respective lengths of the interpolation section $t_1$, $t_2$, $t_3$, $t_4$ . . . can be set freely rather than uniformly. Once the count of the first counter 73A reaches a maximum, the maximum is maintained, so that the change rate memory 77 reads out the change rate data DT corresponding to the maximum. As a matter of course, the first counter 73A performs count operation in time division in each channel as do the other counters so that said waveshape switching count and change rate data DT are read out in time division in each channel. Table 1 below shows an example of change rate data, in decimal, as stored in the change rate memory 77. Table 2 shows time lengths of the interpolation sections $t_1$ to $t_4$ . . . corresponding to the numerical values given in Table 1, T being a given unit time.

TABLE 1

| | tone color | | |
|---|---|---|---|
| | Change Rate Data | | |
| number of switchings | A | B | C |
| 0 | 8 | 8 | 4 |
| 1 | 4 | 8 | 4 |
| 2 | 2 | 4 | 2 |
| 3 | 1 | 2 | 1 |

TABLE 2

| | interpolation section | | | | | |
|---|---|---|---|---|---|---|
| | interpolation section time length | | | | | |
| tone color | $t_1$ | $t_2$ | $t_3$ | $t_4$ | $t_5$ | . . . |
| A | T | 2T | 4T | 8T | 8T | same hereinafter |
| B | T | T | 2T | 4T | 4T | . . . |
| C | 2T | 2T | 4T | 8T | 8T | . . . |

As is clear from the foregoing, use of the cross fade curve memory 84 enables any interpolation characteristics curve to be obtained. Also combination of the counter 73A to count the number of switchings and the change rate memory 77 makes it possible to set any time length of the individual interpolation section.

Specific examples of the segment waveshapes SEG1 to SEG5 will now be described as well as those of tone signals synthesized by interpolation based on those waveshapes.

Figure 13:
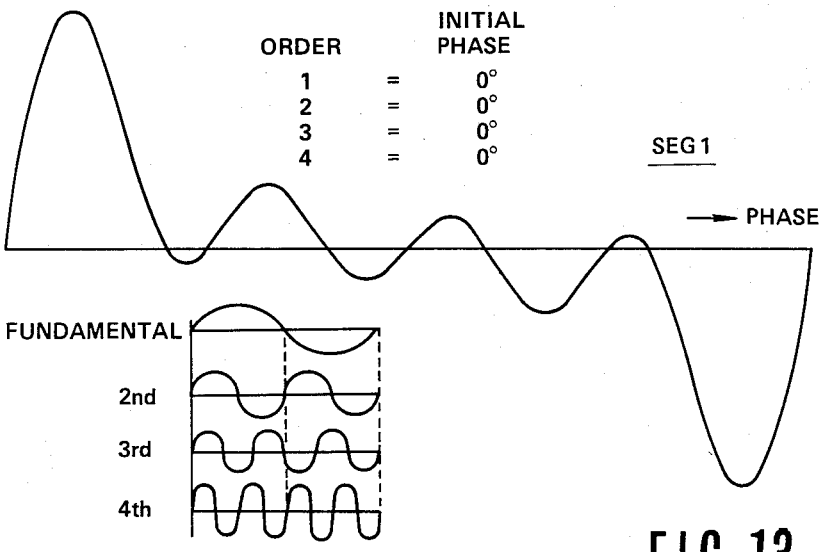
FIGS. 13 to 17 are waveshape diagrams each showing an example of a segment waveshape stored in the waveshape memory shown in FIG. 2, FIG. 13 showing a first switching order segment waveshape SEG1, FIG. 14 showing a second switching order segment waveshape SEG2, FIG. 15 showing a third switching order segment waveshape SEG3, FIG. 16 showing a fourth switching order segment waveshape SEG4, and FIG. 17 showing a fifth switching order segment waveshape SEG5.
Figure 14:
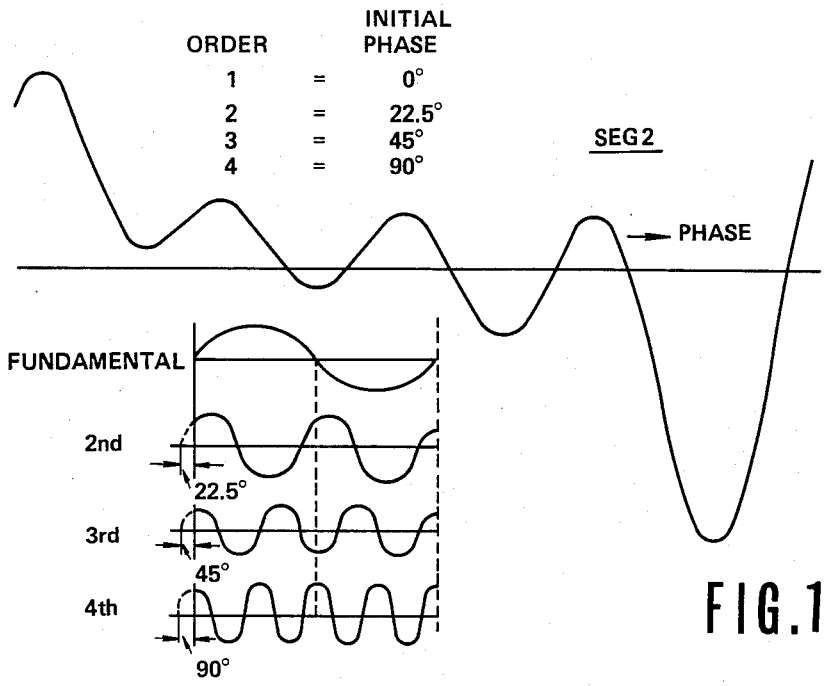
Figure 15:
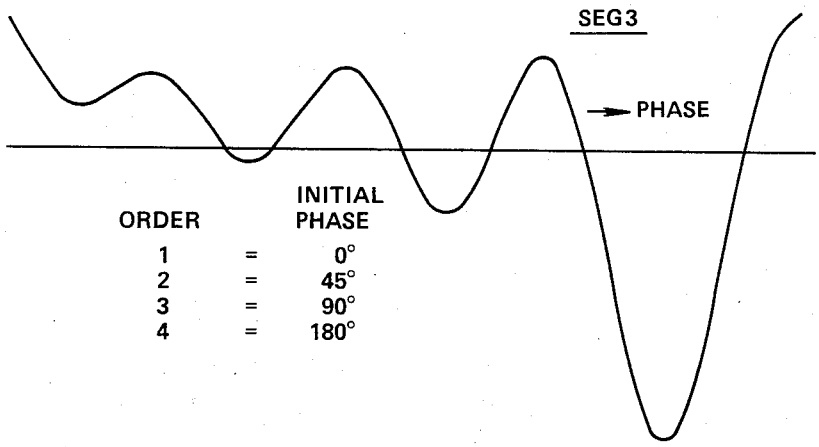
Figure 16:
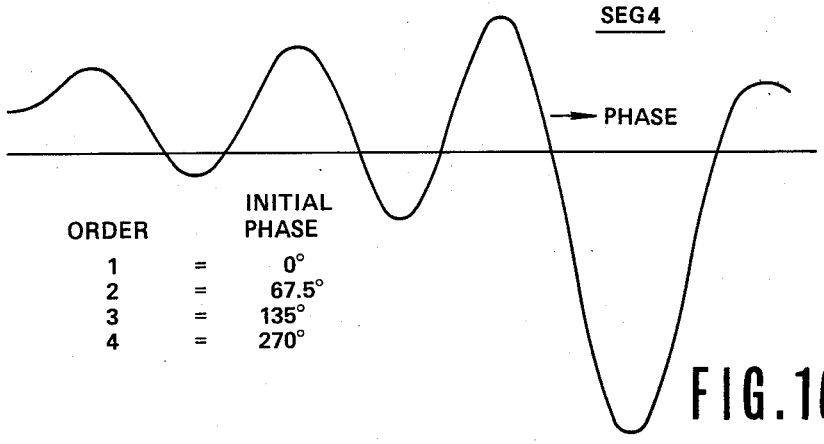
Figure 17:
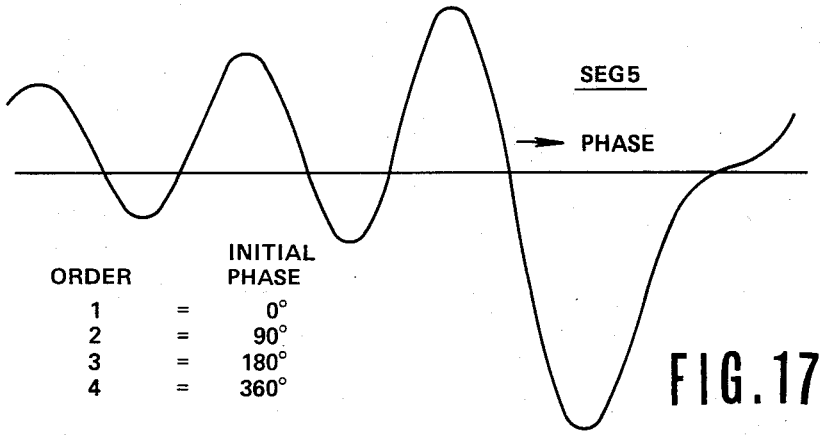

FIGS. 13 to 17 each show an example of the segment waveshapes SEG1 to SEG5. For the sake of simplicity, these segment waveshapes SEG1 to SEG5 are supposed to be composed of four different components of a fundamental wave, second harmonic, third harmonic, and the fourth harmonic as combined with the same relative amplitude. Each figure includes the initial phase of those components (the order number 1, 2, 3, 4). FIGS. 13 and 14 additionally include a diagram showing each component waveshape before synthesis contained in the segment waveshapes SEG1, SEG2.

The waveshapes SEG1 and SEG2, SEG2 and SEG3, SEG3 and SEG4, and SEG4 and SEG5 are adjacent to each other in the switching order.

In this example, in all of the segment waveshapes SEG1 to SEG5, there is provided a given phase difference in the harmonics components between the segment waveshapes adjacent to each other in the switching order. The phase difference in the components of the same order number is the same between any adjacent segment waveshapes. The phase difference varies between the components of different order numbers such that the difference increases with the order number. Specifically, the initial phases of the second harmonics in the segment waveshapes SEG1 to SEG5 are each 0 degree, 22.5 degrees, 45 degrees, 67.5 degrees and 90 degrees, with the phase difference being set to 22.5 degrees between any adjacent waveshapes. The phase difference in the initial phase of the third harmonics component are set to 45 degrees between any adjacent segment waveshapes. The phase difference in the initial phase of the fourth harmonics is set to 90 degrees between any adjacent segment waveshapes.

Figure 18:
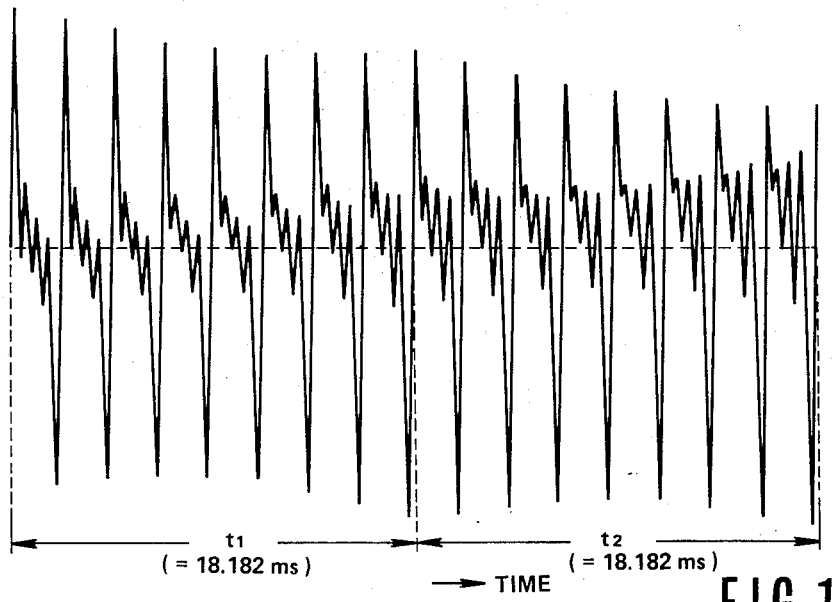
FIGS. 18 and 19 are waveshape diagrams showing examples of tone signals synthesized by the embodiment shown in FIG. 2 using the segment waveshapes of FIGS. 13 to 17.
Figure 19:
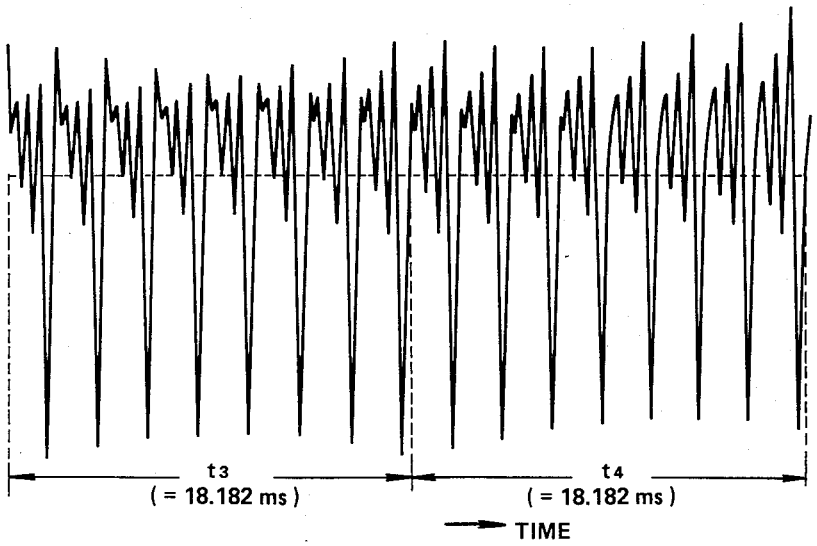

FIGS. 18 and 19 show an example of the tone signals synthesized through interpolation of the segment waveshapes SEG1 to SEG5 shown in FIGS. 13 to 17 using the device shown in FIG. 2. FIG. 8 shows the interpolation sections $t_1$ and $t_2$. FIG. 9 shows the succeeding interpolation sections $t_3$ and $t_4$. FIGS. 18 and 19 show examples of the tone signals where the waveshapes are read out from the waveshape memory 14 according to the basic frequency 440 Hz of the A4 tone and the times of the interpolation sections $t_1$ to $t_4$ are fixed to the time corresponding to eight periods of the A4 tone (18.182 ms).

Figure 20:
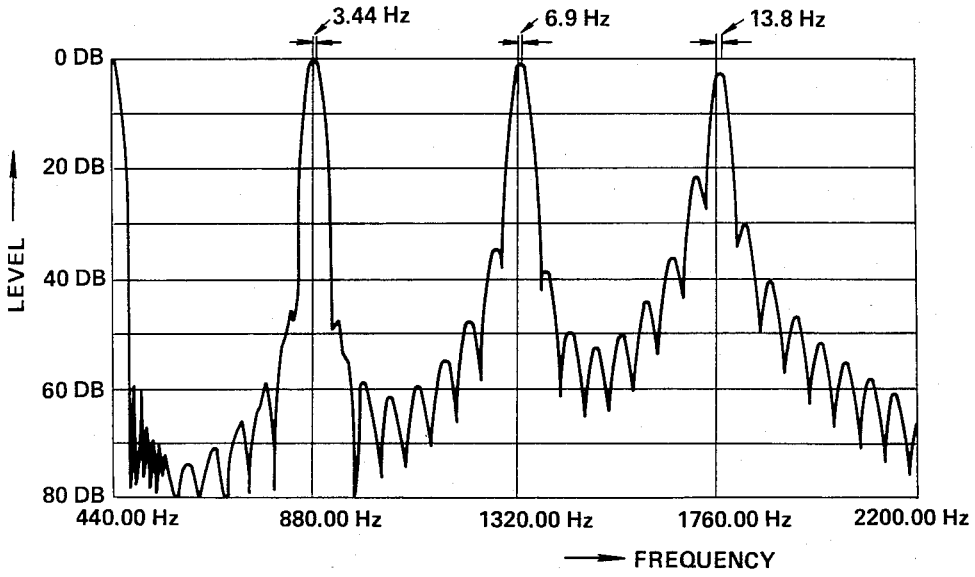
FIG. 20 is a spectrum envelope diagram showing the frequency spectra of the tone signals of FIGS. 18 and 19.

FIG. 20 shows a frequency spectrum of the tone signals shown in FIGS. 18 and 19, with the basic frequency of the A4 tone at 440 Hz.

Figure 21:
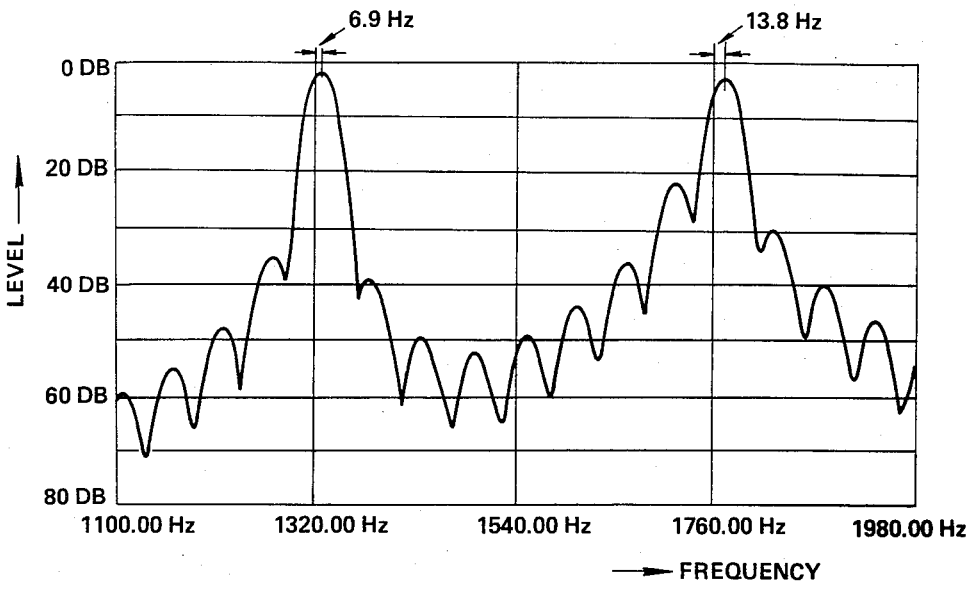
FIG. 21 is a diagram showing the spectrum envelope including the third and fourth harmonics portions.

FIG. 21 is a spectrum diagram showing the third and fourth harmonics shown in FIG. 20 as enlarged in the direction of the horizontal axis. As is obvious from both figures, the frequencies of the second, third and fourth harmonics components different in phase by a given quantity between the adjacent segment waveshapes are out of phase from the proper integer times frequencies according to the quantity of the phase difference. The conditions required in the specific example now described are identical to those illustrated in the paragraph preceding the description on this embodiment summarizing the invention. Therefore, the numerical values $f_2$, $f_3$, $f_4$ can be used unchanged as the frequencies of the harmonics components, namely, 3.44 Hz for the frequency deviation of the second harmonic, 6.9 Hz for the frequency deviation of the third harmonic and 13.8 Hz for the frequency deviation of the fourth harmonic. Non-harmony is realized in this way. The nonharmony as realized in this example where the frequency deviation increases with the order number is close to that of the tones really produced by the piano and harpsichord and thus preferable.

It will be obvious from the foregoing that only a particular harmonic component can be made nonharmonic by providing a phase difference in that component only between the segment waveshapes.

Since it is not necessary to provide a phase difference in a particular component in all segment waveshapes, a phase difference may be provided in a plurality of particular segment waveshapes (e.g., SEG1, SEG2, and SEG3 only). In this case, the nonharmony is realized in a particular interval of the entire sounding period from the start of sounding through the end.

Further, there may be provided a phase difference in the component of the same order number between the segment waveshapes which changes with time (i.e., a phase difference between at least one pair of adjacent segment waveshapes may be made different from the phase difference between the other pairs of adjacent segment waveshapes) rather than a uniform phase difference. Thus the extent of nonharmony (frequency deviation) can change with time (in the interpolation section in which the phase difference varies from the phase difference in the other interpolation sections).

In the example shown in FIGS. 13 to 21, the relative amplitude of the component in the respective segment waveshapes SEG1 to SEG5 are common so that switching of segment waveshapes does not cause change in tone color. However, not only the initial phase of the components but also the relative amplitude may be varied in the segment waveshapes SEG1 to SEG5 so as to realize timewise change in tone color.

Figure 22:
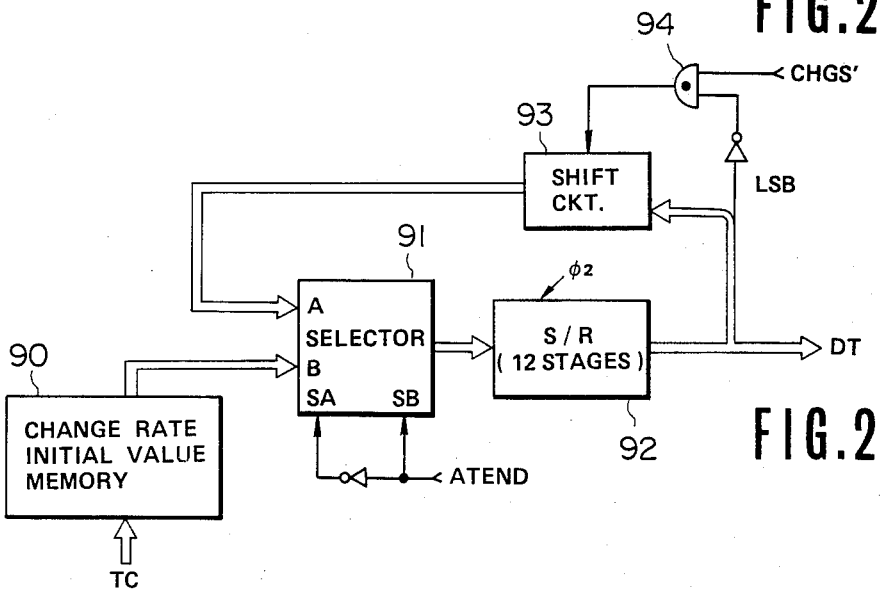
FIG. 22 is an electric block diagram showing a modification of a first counter and a change rate memory shown in FIG. 10, namely, counting rate control means.

A modification of the above embodiment will be described below. The count rate control means including the first counter 73A and the change rate memory 77 shown in FIG. 10 may be modified as shown in FIG. 22. A change rate initial value memory 90 has stored therein only the initial value of the change rate data DT for each tone color and reads out given change rate initial value data according to the tone color selection data TC. A selector 91 selects the initial value data from the memory 90 in response to the attack and signal ATEND instantly only upon termination of the attack and stores it in a shift register 92. The shift register 92 has 12 stages and is capable of storing data for each channel. The output of the last stage of the shift register 92 is produced as the change rate data DT as well as applied to a shift circuit 93 and bit-shifted in response to the control signal from an AND gate 94 to circulate through the A input of the selector 91. The AND gate 94 is supplied with the inverse of the least significant bit LSB of the change rate data DT and the switching synchronizing signal CHGS' delayed by the delay circuit 86 (FIG. 10). By way of example, the shift circuit 93 shifts each bit of the input data one bit to the right when supplied with the signal "1" from the AND gate 94.

The AND gate 94 is enabled when LSB of the data DT is "0", so that the initial value data sotred in the shift register 92 is shifted by one bit to the right each time the switching synchronizing signal CHGS' is generated. The shifting is effected in each channel in time division. When LSB is turned to "1", the AND gate 94 is disabled and the data DT maintains the value. Table 3 below shows an example of the change rate data DT in such case.

TABLE 3

| | tone color Change Rate Data | | | |
|---|---|---|---|---|
| number of switchings | A | B | C | |
| 0 | 8 | 4 | 2 | ← initial value |
| 1 | 4 | 2 | 1 | |
| 2 | 2 | 1 | 1 | |
| 3 | 1 | 1 | 1 | |

The modification shown in FIG. 22 realizes a monotonous change in the change rate data DT but is simple in construction as compared with the embodiment shown in FIG. 10.

Since in the embodiments shown in FIGS. 10 and 22, an interpolation function (basic interpolation function, namely the address signal of the memory 84) which is folded into the form of a triangular wave is obtained by controlling the inversion of the less significant bits according to the value of the most significant bit MSB in the count by the second counter 73B, it is essential that the count of the counter 73B start increasing from all 0s and finally return to all 0s exactly as a result of the overflow. Therefore the value of the change rate data DT is required to be a power of 2 such as "1", "2", "4", and "8". If the change rate data DT is to have any value, the second counter 73B need only be modified as shown in FIG. 23.

Figure 23:
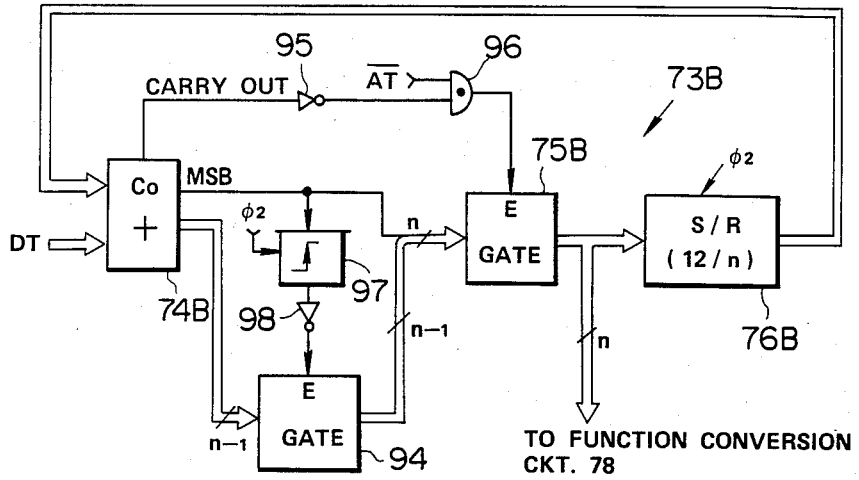
FIG. 23 is an electric block diagram showing a modification of a second counter shown in FIG. 10.

In the counter 72B shown in FIG. 23, the gate 94 is provided between the adder 74B and the gate 75B. The carry-out signal from the most significant bit in the adder 74B is inverted by an inverter 95 before being applied with the inverted attack signal $\overline{AT}$ to an AND gate 96, of which the output controls the gate 75B. The most significant bit MSB in the output signal of the adder 74B is applied to the gate 75B as well as to a rise differentiator circuit 97 and the least significant n-1 bits are applied to the gate 94. The rise differentiator circuit 97 produces the signal "1" in correspondence to one period of the clock pulse $\phi_2$ when MSB rises to the signal "1". This output signal "1" is inverted by an inverter 98 before being applied to the control input of the gate 94. The output of the gate 94 (n-1 bits) and MSB of the adder 74 are applied to the gate 75B as an n-bit signal. The output of the gate 75B is applied to the shift register 76B as well as to the function conversion circuit 78, as described.

During the attack, the AND gate 96 is disabled by the inverted attack signal $\overline{AT}$ at the 0 state, the gate 75B is closed and the count by the counter 73B maintains all 0s. When the attack ends, the gate 75B is opened and, since the gate 94 is normally open, the count operation is made possible so that the value of the change rate data DT is added repeatedly at given time intervals (at one cycle of the channel timing). Thus increases the count at a given rate according to the value of the data DT. When the most significant bit MSB of the addition result changes from "0" to "1", a pulse is produced from the rise differenciator circuit 97 at its channel timing to close the gate temporarily. Since the count increases at any given rate (not necessarily at a rate of a power of 2), the least significant n-1 bits are not necessarily all 0s when MSB of the addition result changes from "0" to "1". However, because, as mentioned above, the gate 94 is closed temporarily, the least significant n-1 bits are forcibly cleared to all 0s so that the count supplied through the gate 75B to the shift register 76B has MSB at the "1" state and the least significant n-1 bits in all 0s.

When the most significant bit MSB of the addition result changes from "1" to "0", i.e., when the carry-out signal is produced from the adder 74B, the AND gate 96 is disabled and the gate 75B closed. In this case also, the output of the adder 74B is not necessarily all 0s since the count is allowed to increase at any given rate. However, the temporary closure of the gate 75B forces the count of the gate 75B to be turned to all 0s.

Accordingly, the output of the function conversion circuit 78 is accurately turned to all 0s or all 1s at the return point so that the detection circuits 82 and 85 (FIG. 10) safely detect all-"0" state or all-"1" state, thus effecting waveshape switching control without trouble. Therefore, according to the construction shown in FIG. 14, the change rate data DT can assume any value without being limited to a power of 2. In this case, switching of the segment waveshapes can be effected exactly when the segment waveshape has been read out for integer periods, by determining the value of the data DT in association with the tone frequency.

In the embodiments described above, the count rate in the counting means 73 is determined, by repeatedly counting the data DT having an appropriate value at given intervals, according to the value of the data DT. However, the count rate may be otherwise determined by, for instance, effecting a variable control on the count time interval (count clock) while maintaining the value of the data DT constant or, alternatively, by effecting a variable control on both the value of the data DT and the count time interval.

In the example shown in FIG. 9, the count in one subchannel (the segment waveshape order data) is equivalently increased by 2 in the start address generation circuit 40 by adding 1 to the count in the other channel. However, the count in one subchannel may be increased by 2 by adding 2 directly to that count using the start address generation circuit 40 constructed as shown in FIG. 24.

Figure 24:
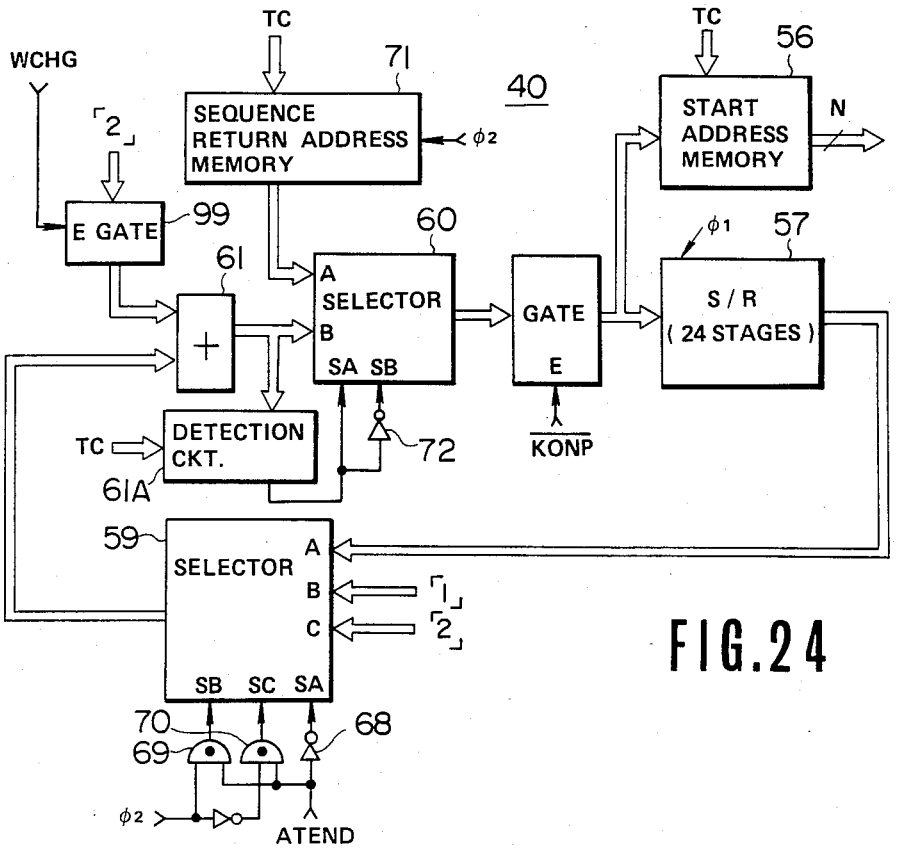
FIG. 24 is an electric block diagram showing a modification of a start address generation circuit shown in FIG. 9.

In FIG. 24, the same characters as used in FIG. 9 denotes identical circuits. The circuits denoted by numerals 58, 63 to 67 in FIG. 9 are omitted in FIG. 24. The output of the shift register 57 is applied directly to the A input of the selector 59. Also, there is provided a gate 99 so that each time the waveshape switching command signal WCHG is supplied, the numerical value data "2" is applied to the adder 61 through the gate 99. Accordingly, when the waveshape switching command signal is generated at the timing corresponding to one of the subchannels, the count produced at the timing corresponding to that subchannel from the shift register 57 is added with the numerical value "2". Thus the circuit shown in FIG. 24 operates in substantially the same manner as that shown in FIG. 9.

Figure 25:
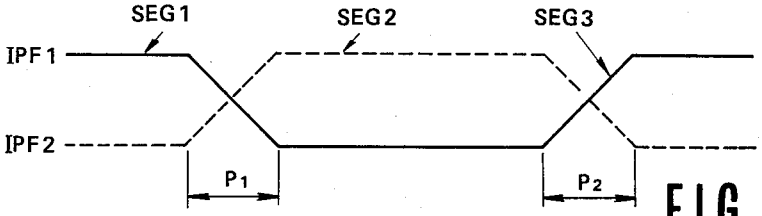
FIG. 25 shows an example of interpolation other than that shown in FIG. 1*b*.

While according to the embodiments described above, the basic interpolation functions IPF1, IPF2 (the address signals of the memory 84) change in the form of a triangular wave as shown in FIG. 1*b* to weight two segment waveshapes at all times, two segment waveshapes may be weighted only at the time of switching. FIG. 25 shows an example of the basic interpolation functions IPF1 and IPF2 (the address signals of the memory 84) in such case. Those functions IPF1 and IPF2 change such that they cross each other, for instance, at a transition $P_1$ from the segment waveshape SEG1 to SEG2, thereafter maintaining the interpolation function IPF2 for SEG2 at its maximum and IPF1 for SEG1 at its minimum. The interpolation functions IPF1, IPF2 change likewise at a transition $P_2$. To effect the control as shown in FIG. 25, the detection circuits 82, 85 shown in FIG. 10 should be so made as to detect the change from the all-"0" state or the all-"1" state in the increasing or decreasing direction, rather than merely detect the all-"0" state or all-"1" state, so that the waveshape switching signal WCHG or the switching synchronizing signal CHGS is produced based on such detection.

While according to the above embodiments, the two channels (subchannels) for interpolation are treated in time division, they may be treated in parallel. While in the circuit shown in FIG. 2, the tone waveshape signals of two channels weighted for interpolation are converted from digital into analog signals after digitally added by the adder 20, the tone waveshape signals may be mixed or allowed to be separately sounded after they are converted into analog signals in each channel separately.

While the waveshape memory 14 shown in FIG. 2 stores the amplitude data at the waveshape sample points as they are, the data may be stored otherwise. For instance, it is feasible to have the differences between the amplitude values at various sample points stored and, after reading out of these values, obtain amplitude data at the sample points by accumulating the read-out values. Alternatively, the real number of the amplitude data at the sample points may be stored, its mantissa section and exponential section separately, to obtain the real number of the amplitude values at the sample points by the operation processing after reading out. There are various manners other than these.

While according to the above embodiments, one period of waveshape is stored as it is in the waveshape memory 14 as the segment waveshape (SEG1, SEG2, . . .), half a period may instead be stored, in which case the positive and negative polarity are alternately added to the read-out half-period waveshape to obtain one period of waveshape. Also the segment waveshape to be stored in the waveshape memory 14 need not necessarily be a one-period waveshape and may be a plural-period waveshape (e.g., 2-period waveshape).

According to the above embodiment, a continuous pluralperiod waveshape is stored as it is in the waveshape memory 14 so that the attack portion of the tone signal is generated by reading it out. However, a plurality of segment waveshapes may be stored in the waveshape memory 14 according to the invention for the attack portion also, so that those waveshapes may be switched successively as they are read out while effecting the interpolation treatment described above at the time of switching, thus producing a tone signal. Further, the segment waveshape interpolation synthesis of the invention may be applied to only part of the sound period.

While the tone signal generation device according to the invention can be used in a polyphonic electronic musical instrument as described above, it can be used also in a monophonic electronic musical instrument and in any tone generation device as well whether it is an electronic musical instrument or not. Further, the invention may be applied to generate not only scale tones but rhythm tones, etc. as well.

While according to the embodiment shown in FIG. 10, the final interpolation function or the cross fade curve data CF is obtained from the memory 84, the functions IPF1, IPF2 may be supplied as they are to the multiplier 18 (FIG. 2) as weighting coefficients without providing the memory 84 or, alternatively, the functions IPF1, IPF2 may be supplied to the multiplier 18 as varied by an appropriate logical operation.

The curves (interpolation functions) stored in the cross fade curve memory 84 (interpolation function store means) need not necessarily be increasing curves as shown by solid lines in FIG. 12*a* to 12*d* but may be decreasing curves as shown by dotted lines. The cross fade curve data CF in the address 0 and the greatest address need not necessarily assume the value 0 or the greatest level exactly.

While according to the invention, the two channels (subchannels) for interpolation are formed in separate channels as from the stage of the phase generator 13, the address signal designating the sample points in one period may be produced in common in both channels while designating the waveshape (start address) separately in the two channels.

According to the above embodiments, the waveshape data on the segment waveshapes SEG1, SEG2, . . . are prepared beforehand in the waveshape memory 14 so that the segment waveshapes (consequently the attack-portion waveshape) are generated by reading out the data. However, the segment waveshapes may be generated by the harmonics synthesis method or the digital filter method using tone waveshape forming means which produces desired tone waveshapes based on parameters (harmonics relative amplitude coefficients or filter coefficients). An embodiment of the invention where tone waveshape forming means utilizing parameters are used will be described below referring to FIG. 26.

Figure 26:
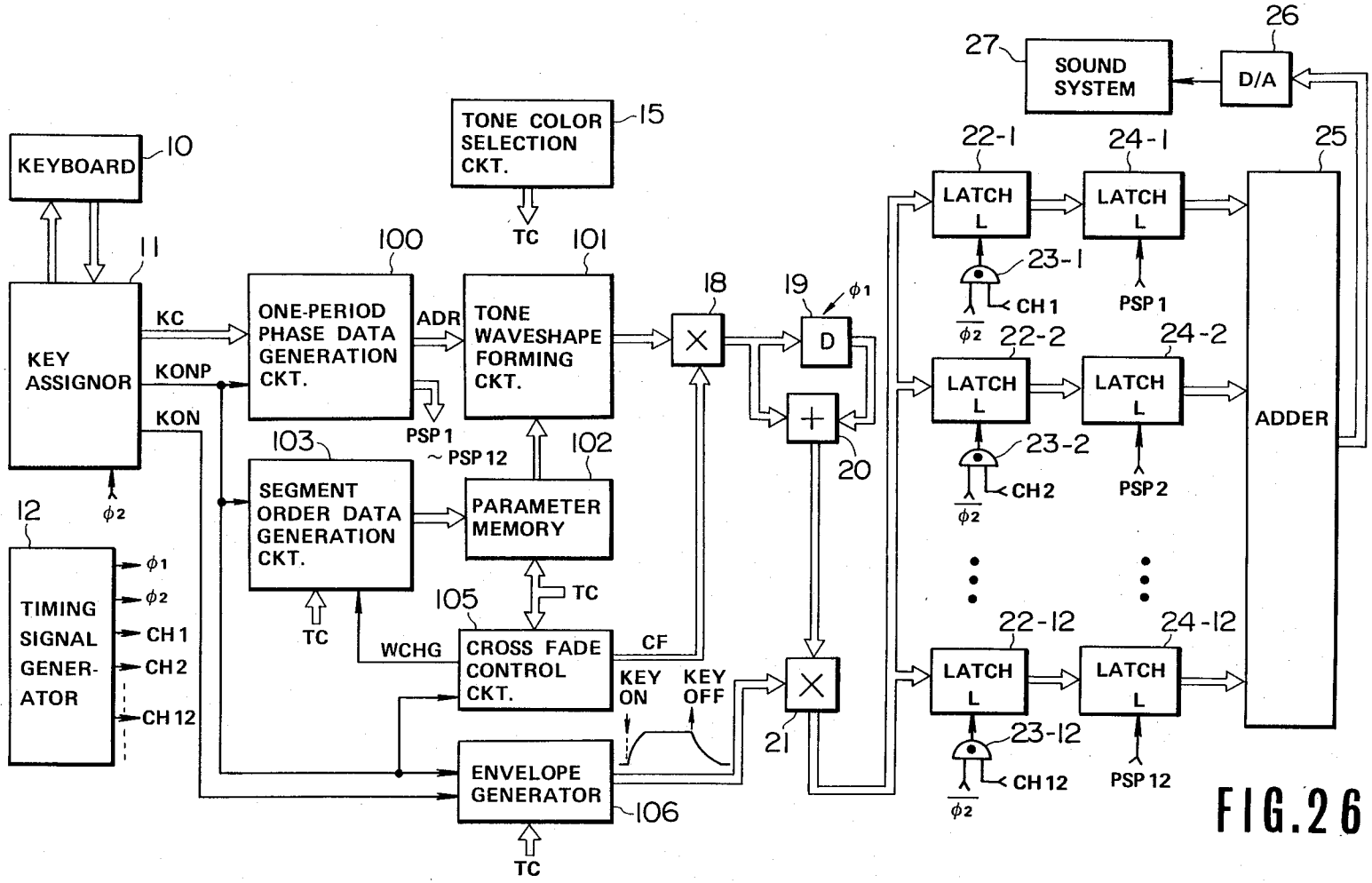
FIG. 26 is an electric block diagram showing another embodiment of the invention.

In FIG. 26, the circuits or devices denoted by the same characters as used in FIG. 2 function identically so that the description thereon is omitted.

A one-period phase data generation circuit 100 is provided to generate phase data ADR sequentially designating the phases (sample points) in one period of the tone waveshape and can be constructed in the same manner as the reading means 28 shown in FIG. 5.

Figure 28:
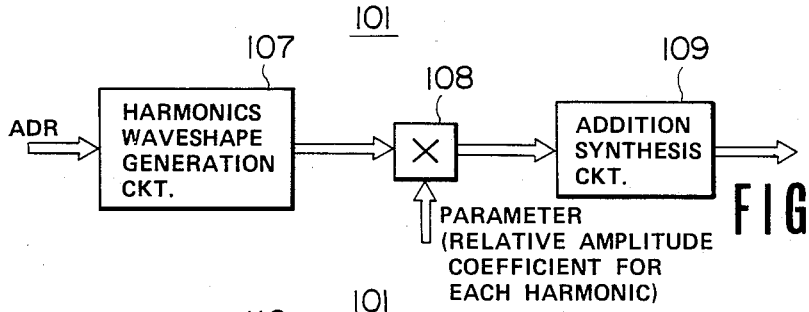
FIG. 28 is a block diagram schematically showing an example of a tone waveshape forming circuit shown in FIG. 26 as constructed by the harmonics synthesizing method.

A tone waveshape forming circuit 101 produces a tone waveshape by a given operation using parameters, of which waveshape the form is determined by said parameters, in correspondence to the phase (sample point) designated by the phase data ADR supplied from said phase data generation circuit 100. The tone waveshape forming circuit 101 may be of a type which, for instance, forms a desired tone waveshape through harmonics synthesis operation. Such harmonics synthesis operation type of tone waveshape forming circuit is disclosed in U.S. Pat. No. 3,821,714 (a type of circuit generating the harmonic signals in parallel) and U.S. Pat. No. 3,809,786 (a type of circuit generating the harmonic signals in time division) so that the details are not given herein. FIG. 28 shows the tone waveshape forming circuit of said type schematically. In this type of circuit, the parameter used in the operation consists of relative amplitude coefficients of harmonics including the fundamental waveshape. The harmonics waveshape generation circuit 107 shown in FIG. 28 generates harmonics signals (including the fundamental waveshape) according to the phase data ADR, a multiplier 108 controls the relative amplitudes of the respective harmonics signals according to the corresponding relative amplitude coefficients (parameters) and an addition synthesis circuit 109 addition-synthesizes these controlled amplitudes to obtain a tone waveshape of a desired characteristic.

A parameter memory 102 stores parameters determining the characteristics (especially the shapes) of various tone waveshapes or the segment waveshapes sampled at intermittent points between the start of the tone sounding and the end. According to this embodiment, the segment waveshapes are sampled at intermittent points in the attack portion as well as in the other part. The segment waveshapes are assigned numerals 1, 2, 3 . . . indicating the order of generation for distinction, as in the above case. The parameter memory 102 stores, as shown in Table 4, parameters a1, a2, . . . , b1, b2, . . . , c1, c2, . . . corresponding to the order 1, 2, . . . of the segment waveshapes for each of the tone colors A, B, C, . . . . According to the tone color selection data TC, a parameter group corresponding to a given tone color is selected and the parameter corresponding to the segment order data generated by the segment order data generation circuit 103 from among the parameter group selected is read out and supplied to the tone waveshape forming circuit 101.

TABLE 4

| | segment order | | | | | |
|---|---|---|---|---|---|---|
| tone color | 1 | 2 | 3 | 4 | 5 | |
| A | a1 | a2 | a3 | a4 | a5 | . . . |
| B | b1 | b2 | b3 | b4 | b5 | . . . |
| C | c1 | c2 | c3 | c4 | c5 | . . . |
| . | . | . | . | . | . | |
| . | . | . | . | . | . | |
| . | . | . | . | . | . | |

Each of the parameters a1, a2, . . . , b1, b2, . . . , c1, c2, . . . correspond to a set of parameters consisting of a plurality of parameters necessary to form a desired segment waveshape. For instance the parameter a2 corresponds to a set of parameters necessary to form the second segment waveshape SEG2 related to the tone color A, the set of parameters consisting, for instance, of relative amplitude coefficients corresponding to the harmonics.

Figure 27:
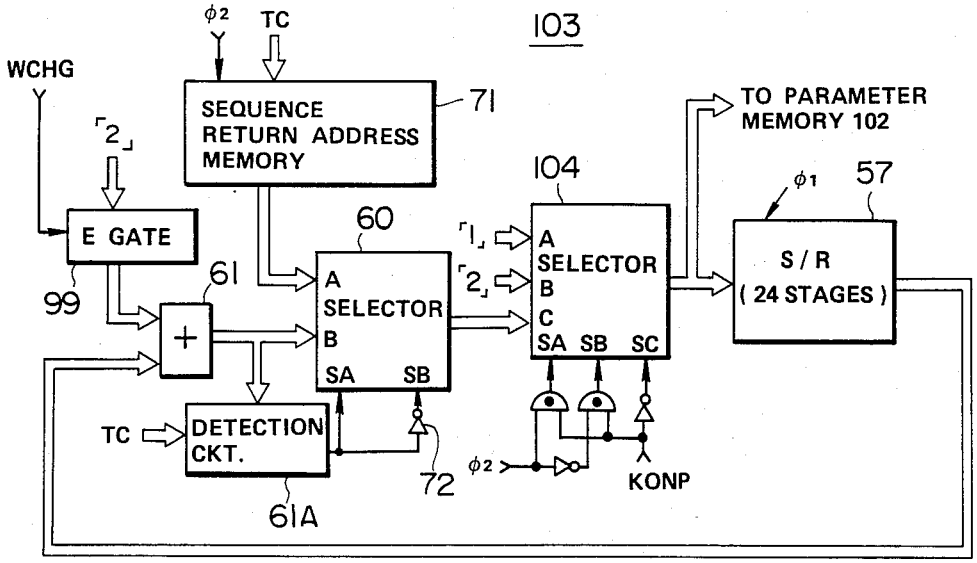
FIG. 27 is an electric block diagram showing an example of a segment order data generation circuit shown in FIG. 26.

The segment order data generation circuit 103, corresponding to the waveshape designation means, produces the segment order data designating the order of the segment waveshapes in time division in each of the subchannels 1 and 2 supplies said data to the parameter memory 102, as described before. FIG. 27 shows a specific example of the circuit 103. The circuits denoted by the characters 57, 60, 61, 61A, 71, 72 and 99 perform the same functions as the circuits denoted by the same characters in FIG. 24 so that detailed description thereof is omitted here. When the key-on pulse KONP is "1" (i.e., at the start of sounding), a selector 104 provided between the selector 60 and the shift register 57 selects the numerical value "1" in the first-half period of the clock pulse $\phi_2$, namely, in the subchannel 1 and selects the numerical value "2" in the second-half period or the subchannel 2. When the key-on pulse KONP is "0", the selector 104 selects the output of the selector 60. Thus at the time of depression of a key, the numerical value "1" is initially set in correspondence to the subchannel 1 and the numerical value "2" in correspondence to the subchannel 2, thereafter the numerical value corresponding to the subchannel at which the command signal WCHG is supplied increasing by 2 each time the signal WCHG is supplied. The output of the selector 104 is supplied to the parameter memory 102 as the segment order data. Therefore, the segment orders of the subchannels 1 and 2 are "1", "2" at first, respectively, thereafter alternately changing by 2 as "3", "2"→"3", "4"→"5", "4"→"5", "6"→. . . .

A cross fade control circuit 105 is basically the same as the cross fade control circuit 16 shown in FIGS. 2 and 10. The difference is that the segment waveshape interpolation is performed also for the attack portion in the cross fade control circuit 105 so that the cross fade curve data CF is formed and produced as early as from the start of sounding. Therefore, the circuit 105 corresponds to the circuit 16 shown in FIG. 10 as modified such that the inverse of the key-on pulse KONP is applied to the control input of the gates 75A, 75B so as to clear the counters 73A, 73B at the start of sounding and that the AND gate 83 in the switching control circuit 81 is omitted so that the output signal of the all-"0" detection circuit 82 is itself the waveshape switching command signal WCHG.

An envelope generator 106, too, is basically the same as the envelope generator 17 shown in FIG. 2 except that the former generates the envelope waveshape signal containing the attack characteristics.

Figure 29:
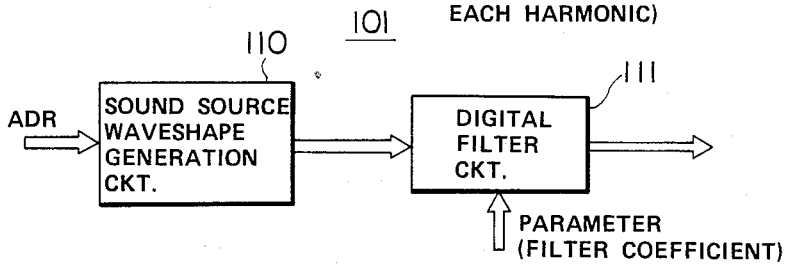
FIG. 29 is a block diagram schematically showing an example of a tone waveshape forming circuit by the digital filter method.
Figure 31:
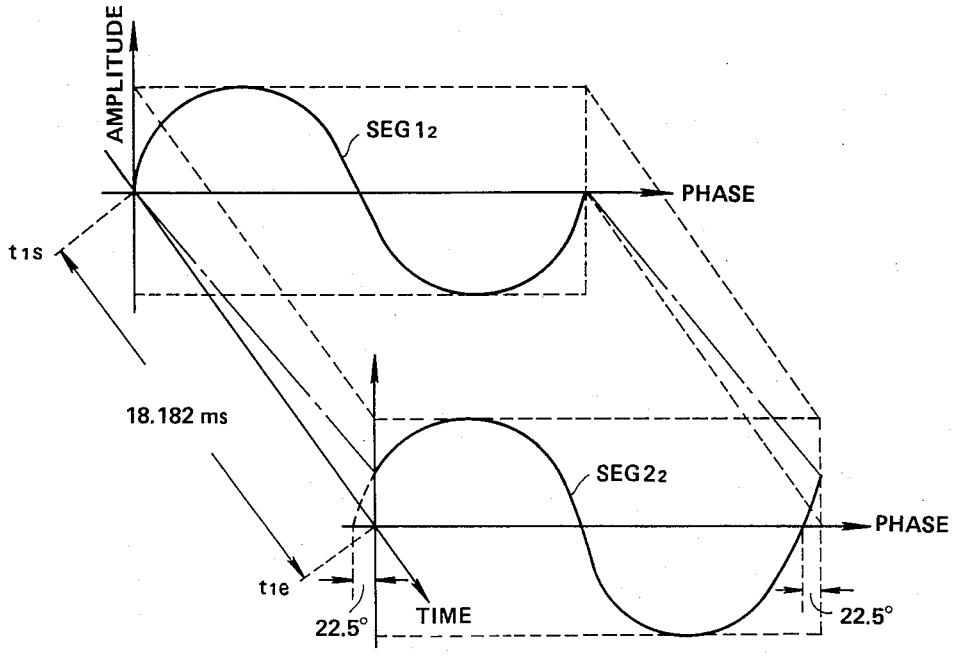
FIG. 31 is a waveshape diagram showing waveshapes (especially the phase relation) of same order components respectively contained in two tone waveshapes to be interpolated, for explaining the principle based on which nonharmonic components are generated by the interpolation synthesis according to the invention.

When the tone waveshape forming circuit 101 is to perform the digital filter type operation, the circuit 101 includes, as shown in FIG. 29, a sound source waveshape generation circuit 110 digitally generating a given sound source waveshape signal according to the phase data ADR, and a digital filter circuit 111 filter-controlling this sound source waveshape signal. In this case, filter coefficients are used as parameters and the parameter memory 102 stores filter coefficients corresponding to the segment waveshapes SEG1, SEG2, SEG3, . . . for each of the tone colors A, B, C, . . . .

The tone waveshape forming circuit 101 can be constructed so as to form tone waveshapes by any parameter operation besides the harmonics synthesis method and digital filter method, such as frequency modulation operation (FM) and the amplitude modulation operation (AM). The circuit 101 may be of any type, provided the tone waveshapes formed can be controlled by parameters. In that case, the kinds of parameters stored in the parameter memory 102 of course vary according to the tone waveshape forming method by the tone waveshape forming circuit 101.

Instead of forming tone signals by interpolation of segment waveshapes for the attack portion, the entire attack-portion waveshapes may be generated by appropriate means as in the embodiment shown in FIG. 2. The full attack-portion waveshapes may be generated, for instance, by having stored a given parameter for every period of the full attack-portion waveshapes in the parameter memory 102 so that the tone waveshape forming circuit 101 may form tone waveshapes for the attack portion using parameters of the respective periods.

The same modifications as those described with regard to the embodiment shown in FIG. 2 may apply to the embodiment shown in FIG. 26.

While according to the example shown in FIG. 11, the switching of the segment waveshapes is controlled having regard to time (irrespective of the pitch of the tone for which the change rate data DT should be generated), the switching may be effected each time the segment waveshape is repeated a given number of periods. In that case, the count by the count means 73 shown in FIG. 10 may be performed, for instance, according to the carry signal CRY from the counter 38 shown in FIG. 38. In this case, the number of periods in which a segment waveshape is to be switched may be varied among the interpolation sections $t_1$, $t_2$, $t_3$ . . . or among tone colors or note names or, alternatively, fixed at a certain number of periods.

As will be clear from the foregoing, the amount of nonharmony obtained according to the invention is determined not only by the phase difference in each component between two segment waveshapes to be interpolated but also by the time required for interpolation. Therefore, once the segment waveshapes are stored in the waveshape memory 14 with desired characteristics (desired phase characteristics of each component), the amount of nonharmony (amount of the frequency deviation from an integer times the frequency) can be controlled variably. This interpolation time control (control of time of the interpolation sections $t_1$ to $t_4$) can be realized by variably controlling the change rate data DT of FIG. 10 or, when, as described above, the switching of the segment waveshapes is effected in every given number of periods, by variably controlling the number of periods.

As described, in the first aspect of the invention, the interpolation functions are generated according to the unique time functions without depending on the number of periods of the tone waveshapes and the switching of the waveshapes is controlled according to these time functions. As a result, it is made possible to obtain a good quality timewise spectrum change as well as a smooth interpolation (waveshape transition) throughout the band without compression of the interpolation time in the higher band.

In the second aspect of the invention, the weighting of one tone waveshape and the following tone waveshape is carried out separately according to the outputs read out in the normal and reverse directions from the memory means storing the interpolation functions for weighting, thereby enabling an impartial (the interpolation in the first half of the interpolation section being symmetrical to the interpolation in the second half) and smooth interpolation. Accordingly, a good quality interpolation can be effected by freely using interpolation functions of desired characteristics.

In the third aspect of the invention, a plurality of tone waveshapes (segment waveshapes) comprising the fundamental wave and the harmonics components are stored in the waveshape memory means and read out by switching one waveshape to another successively while effecting timewise interpolation between tone waveshapes adjacent to each other in the switching order, thereby generating tone signals. Said tone waveshapes to be stored are so determined as to secure a phase difference in at least one component between the adjacent tone waveshapes in order to render said components nonharmonic. As a result, nonharmony can be realized by relatively an easy construction.

We claim:

1. A tone signal generation device comprising:

waveshape memory means for storing waveshape data corresponding to respective sample points of a plurality of different tone waveshapes, each of the respective tone waveshapes being divided into a plurality of said sample points;

waveshape designation means for designating both a set of tone waveshapes to be read out from said waveshape memory means and the timewise switching between the designated tone waveshapes;

readout means for repeatedly reading out waveshape data of a designated tone waveshape from said waveshape memory means in response to the frequency of a tone to be generated, said readout means reading out both a preceding tone waveshape and a following tone waveshape at a time when switching therebetween is designated by said designation means;

interpolation means for weighting both said preceding tone waveshape and said following tone waveshape according to a predetermined interpolation function at said time when the tone waveshape to be read out is switched, so as to achieve smooth transition from the preceding tone waveshape to the following waveshape, thereby to obtain crossfading there between;

counting means for generating a time function for establishing said interpolation function; and switching control means, responsive to the output of said counting means, for controlling switching between waveshapes in said waveshape designation means.

2. A tone signal generation device as defined in claim 1 wherein said switching control means detects that the value of the time function generated by said counting means has changed to a predetermined value and, responsive to this detection, supplies a waveshape switching command signal to said waveshape designation means.

3. A tone signal generation device as defined in claim 1 wherein said counting means comprises counting rate control means for controlling switching of a counting rate in synchronism with the waveshape switching control by said switching control means and a counting circuit performing a counting operation in accordance with this counting rate and generating the time function in response to a count resulting from the counting operation.

4. A tone signal generation device as defined in claim 3 wherein said counting rate control means counts the number of times the tone waveshape has been switched and designates the counting rate corresponding to the counted number of times and said counting circuit performs counting from a first predetermined value to a second predetermined value at said designated counting rate and produces the time function corresponding to the count value resulting from this counting.

5. A tone signal generation device as defined in claim 4 wherein said counting rate control means comprise a counter for counting the number of times the tone waveshape has been switched and a change rate memory for reading out predetermined numerical data in response to the number of times counted by this counter, said numerical data read out from the change rate memory being counted repeatedly at a predetermined time interval in said counting circuit.

6. A tone signal generation device as defined in claim 3 wherein said counting rate control means comprises first means for generating predetermined initial numerical data and second means for sequentially changing this initial numerical data in synchronism with the waveshape switching control and said counting circuit repeatedly counts output numerical data of this second means at a predetermined time interval.

7. A tone signal generation device as defined in claim 1 wherein said plurality of different tone waveshapes to be stored in said memory means are intermittently sampled between start of sounding of a tone and end thereof.

8. A tone signal generation device comprising:

tone waveshape forming means for forming tone waveshapes of shapes determined by parameters in correspondence to phase designated by phase data;

parameter memory means for storing parameters determining shapes of the respective tone waveshapes with respect to a plurality of different tone waveshapes;

phase data generation means for generating said phase data which changes with the frequency of a tone to be generated to supply it to said tone waveshape forming means;

waveshape designation means for designating tone waveshapes to be generated in said tone waveshape forming means, and for designating the timewise switching between the designated tone waveshapes and for reading out a set of the parameters corresponding to each designated tone waveshape from said parameter memory means and supply it to said tone waveshape forming means, said tone waveshape forming means thereby forming both a preceding tone waveshape and a following tone waveshape at a time when switching therebetween is designated by said designation means;

interpolation means for weighting both said preceding tone waveshape and said following tone waveshape according to a predetermined interpolation function at said time when the tone waveshape to be formed is switched, so as to achieve smooth transition from the preceding tone waveshape to the following waveshape;

counting means for generating a time function for establishing said interpolation function; and switching control means, responsive to the output of said counting means, for controlling switching between waveshapes in said waveshape designation means.

9. A tone signal generation device as defined in claim 8 wherein each of said parameters consists of a relative amplitude coefficient corresponding to each of harmonics including a fundamental wave and said tone waveshape forming means forms the tone waveshape by generating a plurality of harmonic signals in response to the phase data and synthesizing these harmonic signals by controlling them by the relative amplitude coefficient corresponding to the respective harmonic signals.

10. A tone signal generation device as defined in claim 8 wherein each of said parameters consists of a digital filter coefficient and said tone waveshape forming means comprises means for generating a predetermined tone source waveshape signal in digital in response to the phase data and a digital filter circuit whose filter characteristics is established in accordance with the digital filter coefficient provided as the parameter and in which the tone source waveshape is controlled in accordance with this characteristics.

11. A tone signal generation device as defined in claim 8 wherein said plurality of different tone waveshapes to be determined by said parameters approximately correspond to a plurality of different tone waveshapes which are intermittently sampled between start of sounding of a tone and end thereof.

12. A tone signal generation device comprising:

waveshape memory means for storing waveshape data corresponding to respective sample points of a plurality of different tone waveshapes, each of the respective tone waveshapes being divided into a plurality of said sample points;

waveshape designation means for designating both a set of tone waveshapes to be read out from said waveshape memory means and the timewise switching between the designated tone waveshape;

readout means for repeatedly reading out waveshape data of a designated tone waveshape from said waveshape memory means in response to the frequency of tone to be generated, said readout means reading out both a preceding tone waveshape and a following tone waveshape at a time when switching therebetween is designated by said designation means; and interpolation means for weighting both said preceding tone waveshape and said following tone waveshape according to a predetermined interpolation function at said time when the tone waveshape to be read out is switched so as to achieve smooth cross fade type transition from the preceding tone waveshape to the following waveshape;

characterized in that said interpolation means comprises:

interpolation function memory means for storing an interpolation function for weighting which changes timewise during a period of time from the start of switching of a tone waveshape to the end thereof; and interpolation control means for effecting weighting of said preceding waveshape and said following waveshape separately by means of an interpolation function output read out in a foreward direction from said interpolation function memory means and an interpolation function output read out in a reverse direction from said memory.

13. A tone signal generation device as defined in claim 12 wherein said interpolation control means comprises address generation means for generating an address signal which changes timewise and inverting means for inverting the value of this address signal and performs the reading out in a forward direction and in a reverse direction respectively by an inverted address signal and an uninverted address signal.

14. A tone signal generation device as defined in claim 13 wherein said address generation means effects switching between a direction in which the address signal increases and a direction in which the address signal decreases each time the tone waveshape switches.

15. A tone signal generation device as defined in claim 12 wherein said interpolation function memory means stores a plurality of said interpolation functions and selects a predetermined interpolation function in response to a tone color selection or other selection operation.

16. A tone signal generation device as defined in claim 12 wherein said plurality of different tone waveshapes to be stored in said memory means are intermittently sampled between start of sounding of a tone and end thereof.

17. A tone signal generation device comprising:

tone waveshape forming means for forming tone waveshapes of shapes determined by parameters in correspondence to phase designated by phase data;

parameter memory means for storing parameters determining shapes of the respective tone waveshapes with respect to a plurality of different tone waveshapes;

phase data generation means for generating said phase data which changes with the frequency of a tone to be generated to supply it to said tone waveshape forming means;

waveshape designation means for designating tone waveshapes to be generated in said tone waveshape forming means, and for designating the timewise switching between the designated tone waveshapes and for reading out a set of the parameters corresponding to each designated tone waveshape from said parameter memory means and supply it to said tone waveshape forming means, said tone waveshape forming means thereby forming both a preceding tone waveshape and a following tone waveshape at a time when switching therebetween is designated by said designation means; and interpolation means for weighting both said preceding tone waveshape and said following tone waveshape according to a predetermined interpolation function at said time when the tone waveshape to be formed is switched, so as to achieve smooth transition from the preceding tone waveshape to the following waveshape;

said interpolation means comprising:

interpolation function memory means for storing an interpolation function for weighting which changes timewise during a period of time from the start of switching of a tone waveshape to the end thereof; and interpolation control means for effecting weighting of said preceding waveshape and said following waveshape separately by means of an interpolation function output read out in a forward direction from said interpolation function memory means and an interpolation function output read out in a reverse direction from said memory.

18. A tone signal generation device as defined in claim 17 wherein each of said parameters consists of a relative amplitude coefficient corresponding to each of harmonics including a fundamental wave and said tone waveshape forming means forms the tone waveshape by generating a plurality of harmonic signals in response to the phase data and synthesizing these harmonic signals by controlling them by the relative amplitude coefficients corresponding to the respective harmonic signals.

19. A tone signal generation device as defined in claim 17 wherein each of said parameters consists of a digital filter coefficient and said tone waveshape forming means comprises means for generating a predetermined tone source waveshape signal in digital in response to the phase data and a digital filter circuit whose filter characteristics is established in accordance with the digital filter coefficient provided as the parameter and in which the tone source waveshape is controlled in accordance with this characteristics.

20. A tone signal generation device as defined in claim 17 wherein said plurality of different tone waveshapes to be determined by said parameters approximately correspond to a plurality of different tone waveshapes which are intermittently sampled between start of sounding of a tone and end thereof.

21. A tone signal generation device comprising:

waveshape memory means for storing waveshape data corresponding to respective sample points of a plurality of different tone waveshapes, each of the respective tone waveshapes being divided into a plurality of said sample points;

waveshape designation means for designating both a set of tone waveshapes to be read out from said waveshape memory means and the timewise switching between the designated tone waveshapes;

readout means for repeatedly reading out waveshape data of a designated tone waveshape from said waveshape memory means in response to the frequency of a tone to be generated, said readout means reading out both a preceding tone waveshape and a following tone waveshape at a time when switching therebetween is designated by said designation means; and interpolation means for weighting both said preceding tone waveshape and said following tone waveshape according to a predetermined interpolation function at said time when the tone waveshape to be read out is switched so as to achieve smooth transition from the preceding tone waveshape to the following waveshape:

characterized in that each tone waveshape stored in said waveshape memory means contains fundamental and harmonic components and, with respect to all or a predetermined plurality of the respective tone waveshapes, a predetermined phase difference is provided to at least one of said components between tone waveshapes whose order of switching is adjacent to each other.

22. A tone signal generation device as defined in claim 21 wherein an amount of the phase difference with respect to components of the same order is the same for any adjacent tone waveshapes.

23. A tone signal generation device as defined in claim 21 wherein an amount of the phase difference with respect to components of the same order is different at least in one set of adjacent tone waveshapes from other sets.

24. A tone signal generation device as defined in claim 21 wherein an amount of the phase difference is different between components of different order.

25. A tone signal generation device as defined in claim 24 wherein an amount of the phase difference increases as the order of harmonics increases.

26. A tone signal generation device as defined in claim 21 wherein said waveshape memory means further stores waveshape of plural periods of an attack portion and said waveshape designation means designates first the waveshape of plural periods of the attack portion and thereafter designates the respective tone waveshape one after another.

27. A tone signal generation device as defined in claim 21 wherein a synthesized tone signal of the two tone waveshapes which have been derived from said interpolation means and have already been weighted contains a nonharmonic component corresponding to the phase difference and an amount of nonharmony is determined by the phase difference and time required for transition between waveshapes in said interpolation means, the amount of the nonharmony being controlled by variably controlling the time required for transition between waveshapes in said interpolation means, i.e., interpolation time.

28. A tone signal generation device comprising:

memory means for storing waveshape data which comprises first to Nth waveshape data corresponding to first to Nth tone waveshapes respectively wherein N is a positive integer greater than or equal to 3, said first to Nth tone waveshapes being different each other;

readout means for reading out the Mth and (M+1)th waveshape data from among said first to Nth waveshape data from said memory means wherein M is an integer less than or equal to N−2;

function generating means for generating a weighting function which is a function of time;

interpolation means connected to said memory means for weighting said Mth and (M+1)th waveshape data in accordance with a weighting value representing a value of said weighting function, for combining the weighted waveshapes and for outputting the combined waveshape at a rate corresponding to a frequency of a musical tone to be produced as a tone signal of said musical tones; and control means for outputting a control signal in relation with said weighting value, said readout means reading out said (M+1)th waveshape data successively and (M+2)th waveshape data newly in response to said control signal.

29. A tone signal generation device as defined in claim 28 wherein said control means comprises detecting means for detecting whether said weighting value coincides with a predetermined value, said control signal being outputted in response to the detection result.

30. A tone signal generation device as defined in claim 28 wherein said first to Nth waveshapes are parts which are intermittently sampled in a waveshape of an actually produced tone.

31. A tone signal generation device as defined in claim 28 wherein said function generating means comprises function memory means for storing said weighting function; and function readout means for reading out said weighting function from said function memory means.

32. A tone signal generation device as defined in claim 28 wherein said weighting function for said Mth and (M+1)th waveshapes differs from the weighting function for said (M+1)th and (M+2)th waveshapes.

33. A tone signal generation device comprising:

parameter memory means for storing first to Nth sets of parameters each of which determines a waveshape of a musical tone to be produced, wherein N is a positive integer greater than or equal to 3;

parameter readout means for reading out the Mth and (M+1)th sets of parameters from among said first to Nth sets of parameters from said parameter memory means;

waveshape forming means capable of forming first to Nth waveshapes corresponding to said first to Nth parameters for receiving said Mth and (M+1)th sets of parameters and for outputting the Mth and (M+1)th waveshapes formed through arithmetic operation based on said Mth and (M+1)th parameters respectively;

function generating means for generating a weighting function which is a function of time;

interpolating means connected to said waveform forming means for weighting said Mth and (M+1)th waveshapes in accordance with a weighting value representing a value of said weighting function, for combining the weighted waveshapes and for outputting the combined waveshape at a rate corresponding to a frequency of a musical tone to be produced as a tone signal of said musical tone; and control means for outputting a control signal in relation with said weighted value, said parameter readout means for reading out said (M+1)th parameters successively and the (M+2)th parameters newly in response to said control signal.

34. A tone signal generation device as defined in claim 33 wherein said waveshape forming means comprises harmonics generating means for generating first to Kth harmonics wherein K is a positive integer greater than or equal to 2, said Mth set of parameters comprising first to Kth harmonic parameters which represent relative amplitudes of said first to Kth harmonics respectively; and operating means for multiplying said first to Kth harmonics with said first to Kth harmonic parameters respectively, for adding the multiplied harmonics and for outputting the added result as said Mth waveshape.

35. A tone signal generation device as defined in claim 33 wherein said waveshape forming means comprises tone source waveshape generating means for generating a tone source waveshape; and digital filter means for filtering said tone source waveshape in accordance with filter characteristic determined by said Mth set of parameters and for outputting the filtered tone source waveshape as said Mth waveshape.

36. A tone signal generation device as defined in claim 33 wherein said control means comprises detecting means for detecting whether said weighting value coincides with a predetermined value, said control signal being outputted in response to the detection result.

37. A tone signal generation device as defined in claim 33 wherein said first to Nth waveshapes are parts which are intermittently sampled in a waveshape of an actually produced tone.

38. A tone signal generation device as defined in claim 33 wherein said function generating means comprises function memory means for storing said weighting function; and function readout means for reading out said weighting function from said function memory means.

39. A tone signal generation device as defined in claim 33 wherein said weighting function for said Mth and (M+1)th waveshapes differs from the weighting function for said (M+1)th and (M+2)th waveshapes.

40. A tone signal generation device comprising:

waveshape generating means, capable of generating first to Nth waveshapes which are different each other, for concurrently generating the Mth and (M+1)th waveshapes from among said first to Nth waveshapes wherein N is a positive integer greater than or equal to 3 and M is a positive integer less than or equal to N−2;

function generating means for generating a weighting function which is a function of time;

interpolation means connected to said waveshape generating means for weighting said Mth and (M+1)th waveshapes in accordance with a weighting value representing a value of said weighting function and for outputting the weighted waveshapes at a rate corresponding to a frequency of a musical tone to be produced as a tone signal of said musical tone; and control means for outputting a control signal in relation with said weighting value, said waveshape generating means continuing to generate said (M+1)th waveshape and beginning to generate the (M+2)th waveshape in reponse to said control signal.

41. A tone signal generation device as defined in claim 40 wherein said control means comprises detecting means for detecting whether said weighting value coincides with a predetermined value, said control signal being outputted in response to the detection result.

42. A tone signal generation device as defined in claim 40 wherein said first to Nth waveshapes are parts which are intermittently sampled in a waveshape of an actually produced tone.

43. A tone signal generation device as defined in claim 40 wherein said function generating means comprises function memory means for storing said weighting function; and function readout means for reading out said weighting function from said function memory means.

44. A tone signal generation device as defined in claim 40 wherein said weighting function for said Mth and (M+1)th waveshapes differs from the weighting function for said (M+1)th and (M+2)th waveshapes.

45. A tone signal generation device as defined in claim 40 wherein said waveshape generating means further generates an attack portion waveshape before generation of said first to Nth waveshapes, said attack portion waveshape being an attack portion of a waveshape of said tone signal.

46. A tone signal generation device comprising:

waveshape generating means for generating a first waveshape and a second waveshape whose fundamental frequencies are same, a phase difference between the respective Nth harmonics of said first and second waveshapes being provided wherein N is a positive integer;

function generating means for generating a weighting function; and interpolation means connected to said waveshape generating means for weighting said first and second waveshapes in accordance with a weighting value representing a value of said weighting function, for combining the weighted waveshapes and for outputting the combined waveshape at a rate corresponding to a frequency of a musical tone to be produced as a tone signal of said musical tone so that said musical tone has a nonharmonic component whose frequency is other than the frequency of said Nth harmonics.

47. A tone signal generation device comprising:

waveshape generating means for generating a first waveshape and a second waveshape;

function generating means for generating a first weighting function and a second weighting function, a value of said first weighting function varying from a first value to a second value along a first curve for a predetermined period, a value of said second weighting function varying from said second value to said first value along a second curve for said predetermined period, said second curve having a shape reversed said first curve; and interpolation means connected to said waveshape generating means for weighting said first waveshape in accordance with a weighting value representing said value of said first weighting function, for weighting said second waveshape in accordance with a weighting value representing said value of said second weighting function, for combining the weighted first and second waveshapes and for outputting the combined waveshape at a rate corresponding to a frequency of a musical tone to be produced as a tone signal of said musical tones.

48. A tone signal generation device as defined in claim 47 wherein said function generating means comprises function memory means for storing said first weighting function and function readout means for reading out said first weighting function in a forward direction from said function memory means to generate said first weighting function and for reading out said first weighting function in a reverse direction from said function memory means to generate said second weighting function.

* * * * *